US007980213B2

(12) United States Patent
Warashina et al.

(10) Patent No.: US 7,980,213 B2
(45) Date of Patent: Jul. 19, 2011

(54) INTERNAL COMBUSTION ENGINE EQUIPPED WITH A VARIABLE VALVE CONTROL SYSTEM

(75) Inventors: Takuya Warashina, Saitama (JP); Yuki Uzawa, Saitama (JP); Yuichi Tawarada, Saitama (JP); Yoshihiro Takada, Saitama (JP); Katsuhiro Kubo, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 124 days.

(21) Appl. No.: 12/586,228

(22) Filed: Sep. 18, 2009

(65) Prior Publication Data

US 2010/0077977 A1 Apr. 1, 2010

(30) Foreign Application Priority Data

Sep. 30, 2008 (JP) ..... 2008-254871

(51) Int. Cl.
*F01L 1/34* (2006.01)

(52) U.S. Cl. ..... 123/90.16; 123/90.39; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS

| | | | | |
|---|---|---|---|---|
| 3,878,822 | A | 4/1975 | Beal | |
| 4,253,434 | A | 3/1981 | Takizawa et al. | |
| 4,354,460 | A | 10/1982 | Mae et al. | |
| 4,584,974 | A | 4/1986 | Aoyama et al. | |
| 4,805,566 | A | 2/1989 | Ampferer | |
| 4,903,651 | A | 2/1990 | Matsuura et al. | |
| 7,669,564 | B2 * | 3/2010 | Tochiki et al. | 123/90.16 |
| 2008/0236526 | A1 | 10/2008 | Yamamoto et al. | |
| 2008/0264369 | A1 | 10/2008 | Yamamoto et al. | |

FOREIGN PATENT DOCUMENTS

| | | |
|---|---|---|
| DE | 10 2008 020155 | 10/2008 |
| JP | 57-188904 | 11/1982 |
| JP | 58-190507 | 11/1983 |
| JP | 58-190507 A | 11/1983 |
| JP | 61-252815 A | 11/1986 |
| JP | 62-000711 | 1/1987 |
| JP | 62-018306 U | 11/1987 |
| JP | 62-184115 U | 11/1987 |
| JP | 62-184117 | 11/1987 |
| JP | 62-184117 U | 11/1987 |
| JP | 62-185810 U | 11/1987 |

* cited by examiner

*Primary Examiner* — Ching Chang
(74) *Attorney, Agent, or Firm* — Carrier Blackman & Associates, P.C.; William D. Blackman; Joseph P. Carrier

(57) ABSTRACT

The invention provides an internal combustion engine equipped with a variable valve control system which switches the actions of an engine valve by sliding a rocker arm in the axial direction of the rocker arm shaft, while enabling the restriction on the sliding movement of the rocker arm to be removed in accordance with the timings of the actions of the rocker arms irrespective of the engine speed. The internal combustion engine includes an actuator that moves a rocker arm shaft in its axial direction, a trigger arm that engages with a rocker arm to prohibit the sliding movement of the rocker arm, and a trigger pin which is configured to be activated by an axial movement of the rocker arm shaft to bring the trigger arm into action, and to disengage the trigger arm from the rocker arm.

20 Claims, 21 Drawing Sheets

INTERNAL COMBUSTION ENGINE EQUIPPED WITH A VARIABLE VALVE CONTROL SYSTEM

CROSS-REFERENCE TO RELATED APPLICATIONS

The present invention claims priority under 35 USC 119 based on Japanese Patent Application 2008-254871, filed on Sep. 30, 2008. The entire subject matter of this priority document, including specification, claims and drawings thereof, is incorporated herein by reference.

BACKGROUND OF THE INVENTION

1. Field of the Invention

The present invention relates to an internal combustion engine equipped with a variable valve control system. More particularly, the present invention relates to an internal combustion engine in which certain selected valves are operable by two different camshafts, which are alternately selectable with a rocker arm to control operation of the valve.

2. Description of the Background Art

A conventional internal combustion engine is known which has been designed to switch between alternate valve actions by use of a rocker arm. The rocker arm is pivotally supported on a rocker arm shaft which is slidably movable in an axial direction thereof. The rocker arm is disposed to selectively link an engine valve with a first or second cam that serves the engine valve. By axially sliding on the rocker arm shaft, the rocker arm selectively engages with one of the two cams to switch the valve actions (see, for example, Patent Document 1).

This known variable valve control system includes an engagement member which is pivotally attached to the rocker arm; a lock groove formed in the rocker arm shaft; and a protruding portion formed on the bottom of the lock groove. At the timing of actions (swings) of the rocker arm while the engine is running at a predetermined speed or faster, the protruding portion flips the engagement member up, so that at these higher speeds of operation, a restriction on the sliding movement of the rocker arm is removed, where such restriction is otherwise imposed by the engagement of the engagement member at lower engine speeds.

[Patent Document 1] JP-A-62-184117

In the above-described conventional configuration, the inertial force generated by the flipping up of the engagement member by the protruding member is used to remove the restriction imposed by the engagement member on the sliding movement of the rocker arm. The inertial force differs, depending on the swinging speed of the rocker arm and accordingly the angular velocity of the rotating cam (which is proportional to the engine speed). The difference in the inertial force sometimes varies the timings at which the restriction imposed on the sliding movement is removed. For this reason, the conventional technique is applicable to engines of limited conditions (i.e., a limited engine-speed range).

An object of the present invention, therefore, is providing an internal combustion engine equipped with a variable valve control system which switches the actions of an engine valve by sliding a rocker arm in the axial direction of the rocker arm shaft and which is capable of removing the restriction on the sliding movement of the rocker arm in accordance with the timings of the actions of the rocker arms irrespective of the engine speed.

SUMMARY OF THE INVENTION

In order to achieve the above objects, a first aspect of the present invention provides an internal combustion engine (e.g., an engine 1 in an illustrative embodiment) equipped with a variable valve control system in which: a rocker arm (e.g., rocker arms 13 and 17 in the embodiment) includes an actuator portion disposed between an engine valve (e.g., an intake and an exhaust valves 6 and 7 in the embodiment) and first and second cams (e.g., left and right first cams 15*a* and 16*a* as well as left and right second cams 15*b* and 16*b* in the embodiment) for the engine valve.

The rocker arm is pivotally supported by a rocker arm shaft (e.g., rocker arm shafts 14 and 18 in the embodiment, respectively) and is slidably movable in an axial direction of the rocker arm shaft, in response to a movement of the rocker arm shaft, and selectively engages with one of the two cams, whereby actions of the engine valve are switched from one set of cams to the other.

The internal combustion engine includes: an actuator (e.g., a hydraulic actuator 65 in the embodiment) that moves the rocker arm shaft in the axial direction thereof; a stopper (e.g., a trigger arm 33 in the embodiment) that engages with the rocker arm to prohibit the rocker arm from sliding; and a release member (e.g., a trigger pin 37 in the embodiment). During engine operation, the release member is activated by an axial movement of the rocker arm shaft and moves the stopper to disengage it from the rocker arm.

A second aspect of the present invention provides an internal combustion engine equipped with a variable valve control system with the following additional features.

With the movement of the rocker arm shaft in the axial direction thereof, the release member moves in a direction orthogonal to the axial direction, and thereby moves the stopper to disengage the stopper from the rocker arm.

A third aspect of the present invention provides an internal combustion engine equipped with a variable valve control system as described above, with the following additional features. The rocker arm shaft has a cut-away recessed portion (e.g., a cut-away recessed portion 61 in the embodiment) formed in an outer circumference thereof, the cut-away recessed portion having a slope (e.g., slopes 61*b* and 61*c* in the embodiment), which is inclined with respect to the axial direction. The release member is placed on top of the slope by the axial movement of the rocker arm shaft, and thereby moves in the direction orthogonal to the axial direction.

A fourth aspect of the present invention provides an internal combustion engine equipped with a variable valve control system as described above, with the following additional features. The cut-away recessed portion includes a flat bottom face (e.g. a bottom face 61*a* in the embodiment) which is contiguous with the slope, and which is parallel to the axial direction. The release member includes a supported portion (e.g., a supported portion 37*c* in the embodiment) that is supported on top of the bottom face before the release member is activated by the axial movement of the rocker arm shaft.

A fifth aspect of the present invention provides an internal combustion engine equipped with a variable valve control system as described above, with the following additional features. The bottom face has a larger width, in the axial direction, than the width of the slope. The supported portion of the release member is supported, in the axial direction, on top of a central portion of the bottom base, before the release member is activated by the axial movement of the rocker arm shaft.

A sixth aspect of the present invention provides an internal combustion engine equipped with a variable valve control system as described above, with the following additional features. The rocker arm shaft has a slit-shaped through-hole (e.g., a through-hole 62) formed therein, the through-hole passing through the rocker arm shaft in a direction orthogonal to the axial direction and having its longitudinal side extending in the axial direction. The release member has an inserting portion formed herein, the inserting portion being inserted into the through-hole so as to be movable in the axial direction.

A seventh aspect of the present invention provides an internal combustion engine equipped with a variable valve control system as described above, with the following additional features. The through-hole is formed in a substantially central portion of the width of the cut-away recessed portion in the direction orthogonal to the axial direction. The through-hole is formed so as to extend in the axial direction in an area corresponding to the entire length of the cut-away recessed portion. A wider portion (e.g., a wider portion 37*b* in the embodiment) is formed in an end portion of the inserting portion of the release member, the wider portion having a larger width in the direction orthogonal to the axial direction than both the inserting portion and the through-hole. The wider portion is provided with the supported portion that is to come into contact with the slope of the cut-away recessed portion.

An eighth aspect of the present invention provides an internal combustion engine equipped with a variable valve control system as described above, with the following additional features. The inserting portion penetrates the rocker arm shaft by passing through the through-hole, and thereby sticks out from the outer-circumference surface of the rocker arm shaft. The wider portion also sticks out from the outer-circumferential surface of the rocker arm shaft. A fitting hole (e.g., fitting holes 19*a* and 19*b* in the embodiment) is formed in a shaft-insertion boss (e.g., an shaft-insertion boss 13*a* in the embodiment) of the rocker arm so that the sticking-out portions of the inserting portion and the wider portion can be inserted into and fitted to the fitting hole.

EFFECTS OF THE INVENTION

According to the first aspect of the present invention, the restriction on the sliding movement of the rocker arm can be removed irrespective of the engine speed by an axial movement of the rocker arm shaft caused by activating the actuator in accordance with the timings of the actions of the rocker arm. Consequently, the rocker arm can slidably move in accordance with the timings of the actions of the rocker arm.

According to the second aspect of the present invention, the stopper can be reliably disengaged from the rocker arm by moving the release member in the direction orthogonal to the axial direction of the rocker arm shaft.

According to the third aspect of the present invention, a mechanism with only a simple configuration is needed to move the release member in the direction orthogonal to the axial direction of the rocker arm shaft.

According to the fourth aspect of the present invention, the release member can be kept in a non-action state reliably and stably before the action of the release member, that is, while the engine is running ordinarily without switching the cams.

According to the fifth aspect of the present invention, the release member can be supported safely in the non-action state before the action of the release member, that is, while the engine is running ordinarily without switching the cams. Thereby, no erroneous action of the release member will be caused by such factors as the engine vibrations and so that the restriction on the sliding movement of the rocker arm can be reliably removed.

According to the sixth aspect of the present invention, the inserting portion of the release member is inserted into the slit-shaped through-hole having its longitudinal side extending in the axial direction of the rocker arm shaft. The insertion prevents the release member from rotating about the rocker arm shaft, and thus prevents the release member from being supported on top of the slope. Consequently, the restriction on the sliding movement of the rocker arm can be reliably removed.

According to the seventh aspect of the present invention, the supported portion is formed as the portion by which the wider portion formed in the one end portion of the inserting portion is supported on top of the slope of the cut-away recessed portion. Accordingly, the surface pressure at the time when the release member (the supported portion) is supported on top of the slope is diffused, so that the release member can be moved smoothly.

According to the eighth aspect of the present invention, the two end portions of the release member can be supported at two positions by use of the shaft-insertion boss of the rocker arm, so that the force acting on the release member can be diffused. Consequently, the strength and the rigidity of the release member can be secured efficiently.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
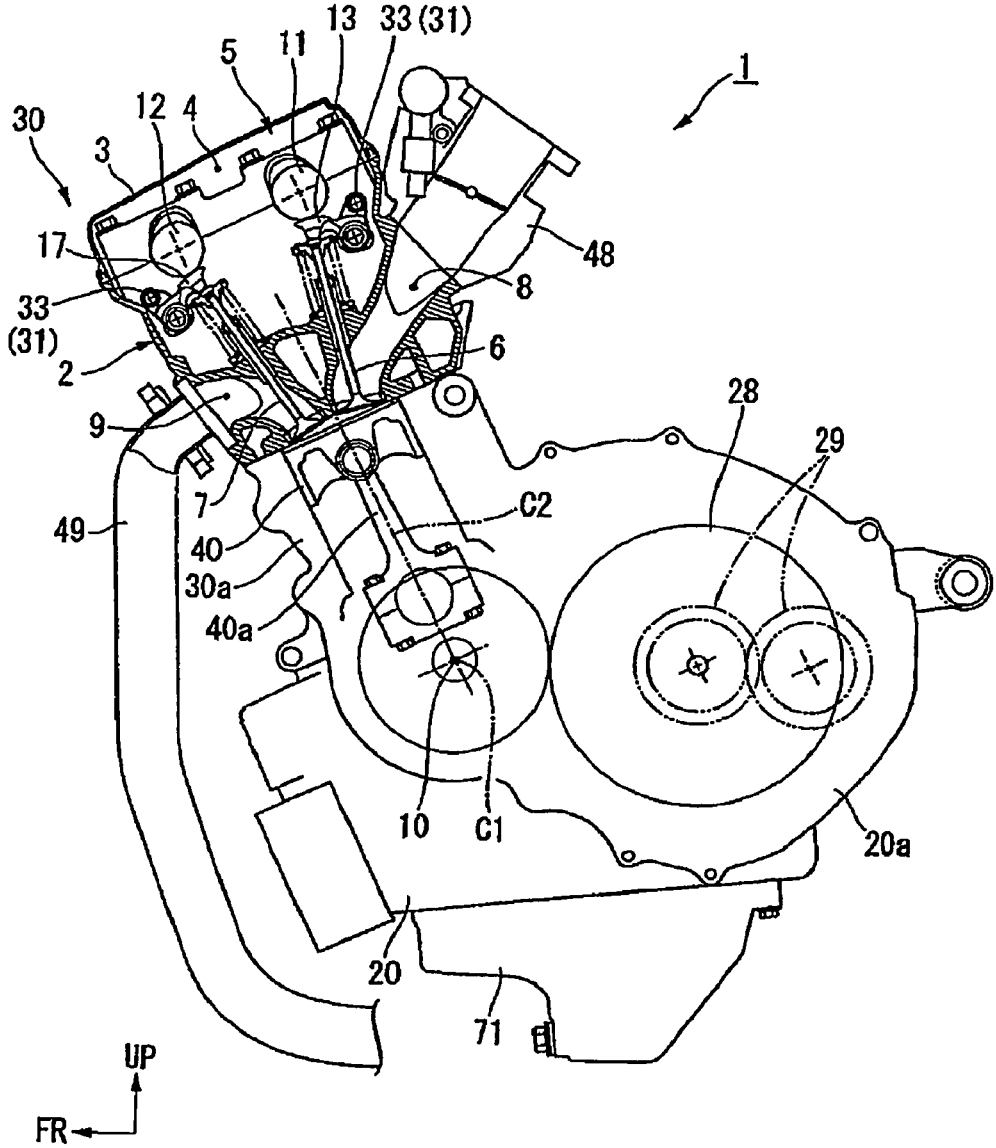
FIG. 1 is a left-side plan view of an engine according to an illustrative embodiment of the present invention, with a cylinder head portion of the engine shown in cross-section.

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. The arrows FR, LH, and UP in the drawings indicate the front-side, the left side, and the upside of the vehicle, respectively. It should be understood that these terms are used for purposes of illustration, and are not intended to limit the invention.

Figure 22:
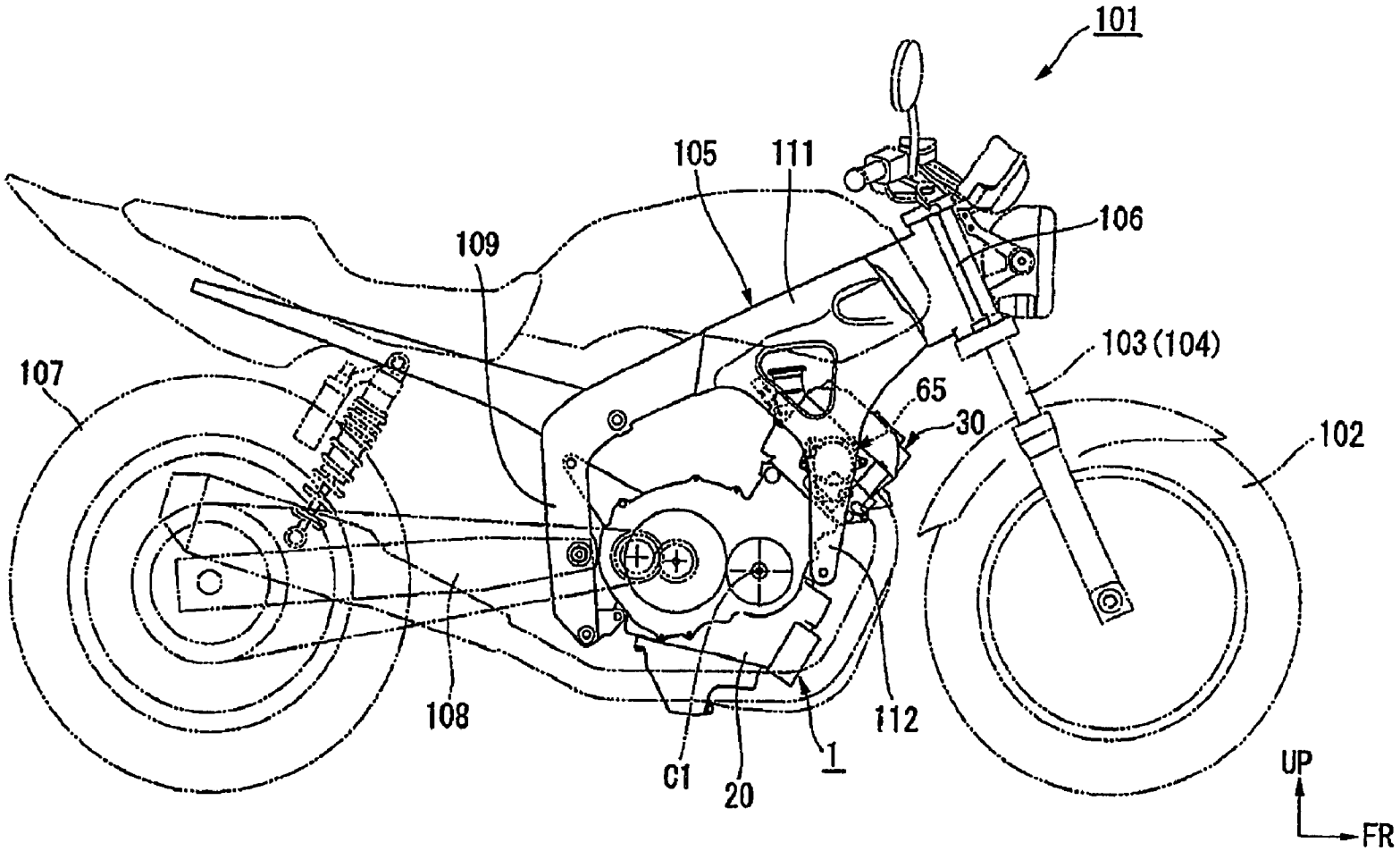
FIG. 22 is a right-side plan view of a motorcycle equipped with the engine hereof.

FIG. 1 shows a left-side plan view of an engine (internal combustion engine) 1, which is the prime mover of a saddle-type vehicle such as a motorcycle 101 (FIG. 22). The engine 1 is a transversely-mounted in-line four-cylinder engine with a rotational center axis C1 of a crankshaft 10 (also referred to as a crankshaft axis C1) aligned in the vehicle width direction (in the right-and-left direction). The engine 1 includes four cylinders 30 extending upwardly on top of a crankcase 20 so as to tilt forwardly (i.e., the upper portion of each cylinder is positioned forward of the lower portion thereof).

The cylinders 30 are arranged along the crankshaft axis C1. Pistons 40 are fitted respectively to the cylinders 30 so as to be reciprocally movable. The reciprocating movements of the pistons 40 are converted to rotating movement of the crankshaft 10 by means of connecting rods 40*a*. Throttle bodies 48 are connected respectively to the rear sides of the cylinders 30 while exhaust pipes 49 are connected respectively to the front sides of the cylinders 30. A line denoted by C2 in FIG. 1 represents the cylinder center axis (simply referred to as a cylinder axis), which extends in the direction in which each cylinder 30 stands.

A transmission case 20*a* is contiguously formed from the rear side of the crankcase 20. A transmission 29 is installed in the transmission case 20*a*, and a clutch 28 is installed in the right side portion of the transmission case 20*a*. The power of rotating crankshaft 10 is outputted to the outside of the engine by means of the clutch 28 and the transmission 29.

Each cylinder 30 includes a cylinder body 30*a*, a cylinder head 2, and a head cover 3. The cylinder body 30*a* is formed on top of the crankcase 20 integrally (or, may be assembled as a separate body to the top of the crankcase 20). The cylinder head 2 is assembled to the top of the cylinder body 30*a*. The head cover 3 is assembled to the top of the cylinder head 2. A valve mechanism (valve system) 5 is provided in a valve chamber 4 formed by the cylinder head 2 and the head cover 3. The valve mechanism 5 is provided for selectively controlling the operation of intake valves 6 and exhaust valves 7.

An intake port 8 is formed in a rear-side portion of each cylinder head 2, and an exhaust port 9 is formed in a front-side portion thereof. A pair of combustion-chamber side openings are formed respectively by the intake and exhaust ports 8 and 9, and are opened and closed by the intake and exhaust valves 6 and 7, respectively. The engine 1 of this embodiment adopts the four-valve system; a right-and-left pair of intake valves 6 and a right-and-left pair of exhaust valves 7 are provided for each cylinder 30.

Figure 2:
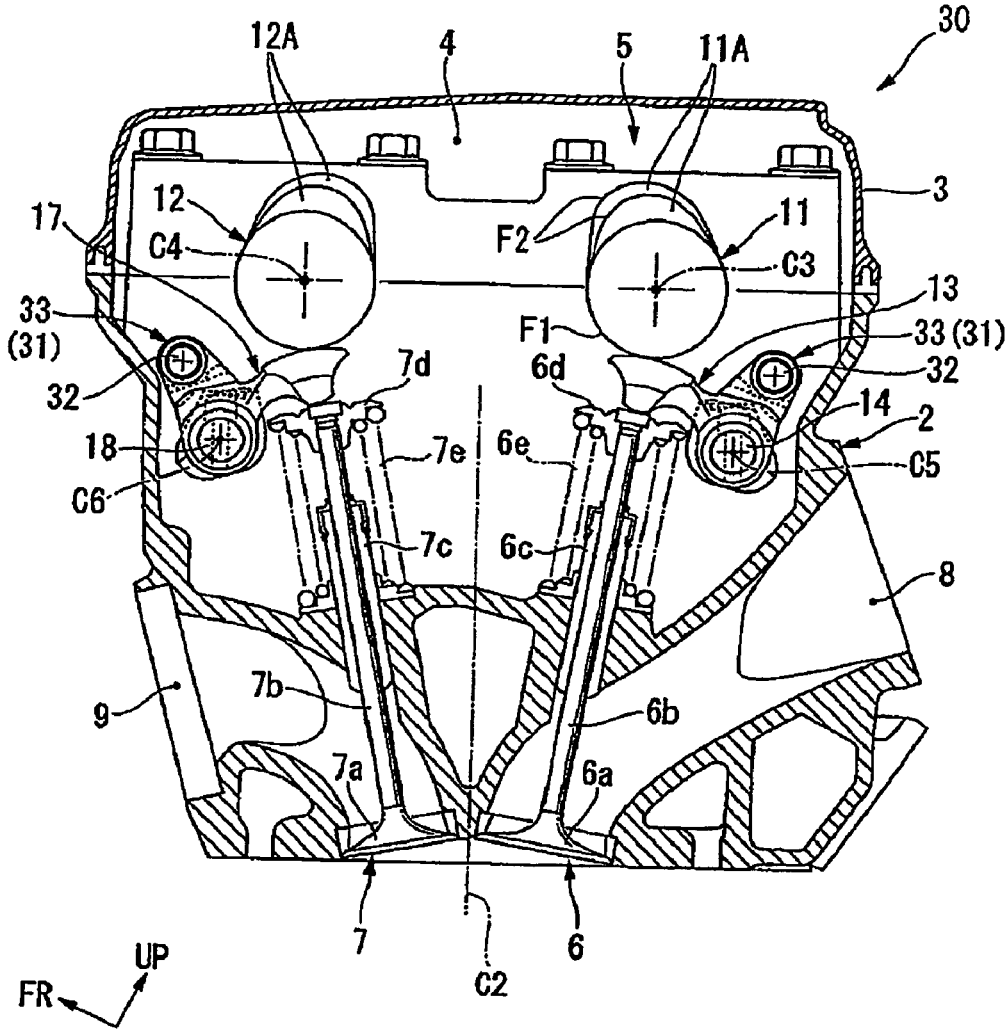
FIG. 2 is a left-side plan view, partially in cross-section, illustrating the cylinder head portion of the engine.

As shown in FIG. 2, the intake and exhaust valves 6 and 7 each include a parasol-shaped valve head 6*a*, 7*a* respectively fitted to the combustion-chamber side opening, and a rod-shaped stem 6*b* or 7*b* extending toward the valve chamber 4. The stems 6*b* and 7*b* of the intake and exhaust valves 6 and 7 are slidably held by the cylinder head 2 with valve guides 6*c* and 7*c*, respectively. Retainers 6*d* and 7*d* are fixed respectively to the leading-end portions of the stems 6*b* and 7*b* that are located in the valve chamber 4). Valve springs 6*e* and 7*e* are each compressively provided between the retainer 6*d* or 7*d* and a corresponding seat formed in the cylinder head 2. When the intake and exhaust valves 6 and 7 are biased upwardly, by the spring force of the valve springs 6*e* and 7*e*, the valve heads 6*a* and 7*a* close the combustion-chamber side openings, respectively. In contrast, when the intake and exhaust valves 6 and 7 are pressed downwardly against the biasing force by a camshaft stroke, the valve heads 6*a* and 7*a* of the intake and exhaust valves 6 and 7 are made to depart from and to open the combustion-chamber side openings.

Each of the stems 6*b* and 7*b* of the intake and exhaust valves 6 and 7 are provided obliquely relative to the cylinder axis C2 to form a V-shape when viewed from a side. An intake-side camshaft 11 extending in the right-and-left direction is provided above the stems 6*b*, and an exhaust-side camshaft 12 extending in the right-and-left direction is provided above the stems 7*b*. Each of the camshafts 11 and 12 is rotatably supported, on its own axis, by the cylinder head 2. While the engine 1 is running, the camshafts 11 and 12 are linked with and driven by the crankshaft 10 by use of a timing chain transmission mechanism. The points denoted by C3 and C4 in FIG. 2 are respective center axes of the camshafts 11 and 12 (also referred to as cam axes).

An intake-side rocker arm 13 is provided for each cylinder 30, and is selectively pivotally moved by cams 11A, formed on the intake-side camshaft 11, to press the right-and-left pair of intake valves 6 for each cylinder 30. This movement of the rocker arm 13 operates the right-and-left pair of intake valves 6. Likewise, an exhaust-side rocker arm 17 is provided for each cylinder 30, and helps cams 12A formed on the exhaust-side camshaft 12 to press the right-and-left pair of exhaust valves 7 for each cylinder 30. The pivotal movement of the rocker arm 17 operates the exhaust valves 7.

An intake-side rocker arm shaft 14 is provided in the cylinder head 2, and is oriented so as to be parallel with the intake-side camshaft 11. The intake-side rocker arm shaft 14 pivotally supports the intake-side rocker arm 13, so that the intake-side rocker arm 13 can swing about the axis of the intake-side rocker arm shaft 14, and can also slide in the axial direction of the intake-side rocker arm shaft 14.

An exhaust-side rocker arm shaft 18 is also provided at the front side of the leading-end portions of the stems 7*b* of the exhaust valves 7. The rocker arm shaft 18 is oriented so as to be parallel with the exhaust-side camshaft 12. The exhaust-side rocker arm shaft 18 pivotally supports the exhaust-side rocker arm 17, so that the exhaust-side rocker arm 17 can swing about the axis of the exhaust-side rocker arm shaft 18 and can also slide in the axial direction of the exhaust-side rocker arm shaft 18. The points denoted by C5 and C6 in FIG. 2 are center axes of the rocker arm shafts 14 and 18 (also referred to as rocker axes), respectively.

Figure 3A:
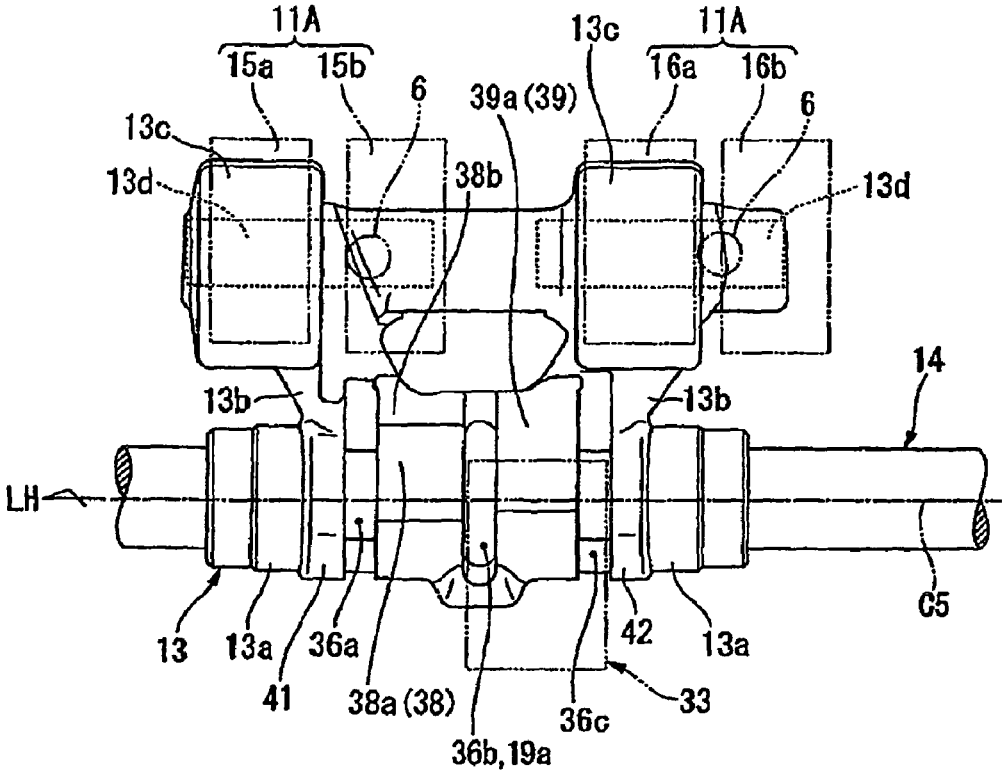
FIG. 3A is a top plan view illustrating a first operation position for an intake-side rocker arm of the engine.
Figure 3B:
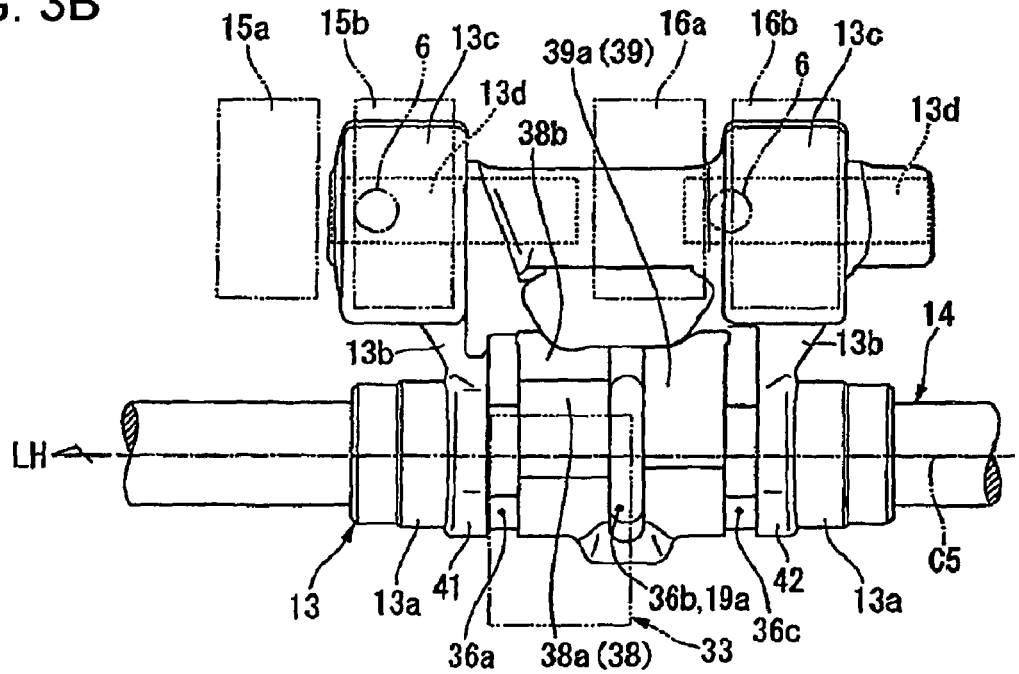
FIG. 3B is a top plan view illustrating a second operation position of the rocker arm.
Figure 5:
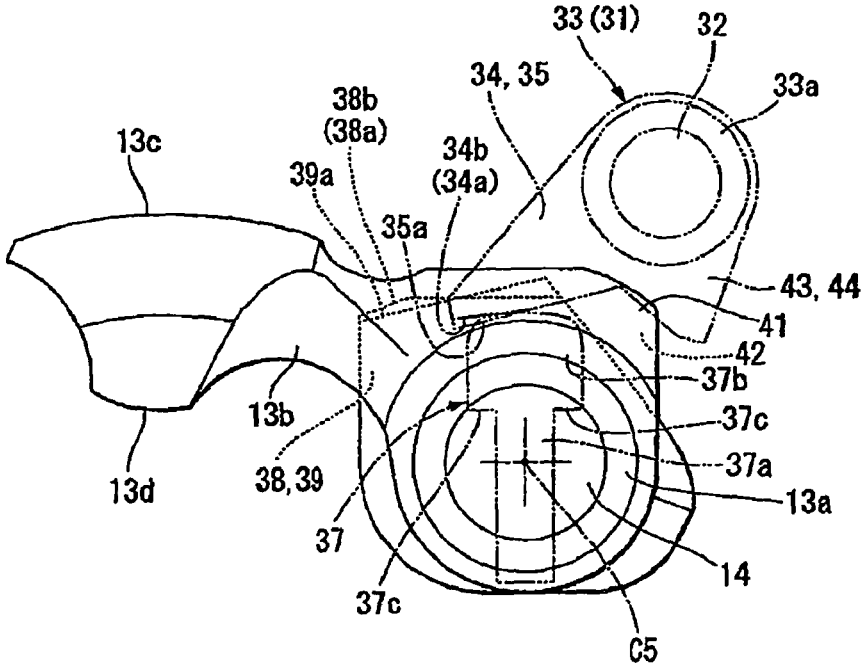
FIG. 5 is a left-side plan view showing the rocker arm in the state where the rocker arm is located at the first operation position.

Now refer also to FIGS. 3A-3B and 5. The intake-side rocker arm 13 includes a cylindrical base portion 13*a*, and the intake-side rocker arm shaft 14 is inserted into the base portion 13*a* (accordingly, the base portion 13*a* is also referred to as a shaft-insertion boss). The intake-side rocker arm 13 also includes two arm portions 13*b*, which extend outwardly from the base portion 13*a*, in bifurcated divergent fashion, towards the stems 6*b* of the corresponding intake valves 6. The outer ends of the arm portions 13*b* are interconnected by an integral reinforcing member extending therebetween.

A cam-contact portion 13*c* is formed on top of the leading-end portion of each of the arm portions 13*b*. The cam-contact portion 13*c* is the part of the rocker arm 13 that is slidably contacted by the cam 11A of the intake-side camshaft 11. A valve-pressing portion 13*d* is formed in the lower-side portion of the leading-end portion of each of the arm portions 13*b*. The valve-pressing portion 13*d* is the portion that is brought into contact with, and presses down on the leading-end portion of the corresponding stem 6*b*.

Though no drawing that describes in detail the exhaust-side rocker arm 17 is given, it will be understood that the exhaust-side rocker arm 17 has a similar configuration to that of the intake-side rocker arm 13, as shown and described herein. Specifically, the exhaust-side rocker arm 17 includes a cylindrical base portion, an arm portion, a cam-contact portion, and a valve-pressing portion. The exhaust-side rocker arm shaft 18 is inserted into the base portion (shaft-insertion boss). The arm portion extends from the base portion towards the leading-end portions of the stems 7*b* of the exhaust valves 7. The cam-contact portion is formed in the upper-side portion of the leading-end portion of the arm portion. The cam-contact portion is the is the part of the rocker arm 17 that is slidably contacted by the cam 12A of the exhaust-side camshaft 12. The valve-pressing portion is formed in the lower-side portion of the leading-end portion of the arm portion. The valve-pressing portion is the portion that is brought into contact with, and presses down in the leading-end portion of the stem 7*b*.

While the engine 1 is running, the camshafts 11 and 12 that are linked with the crankshaft 10 are driven to rotate. The rocker arms 13 and 17 swing in accordance with the profiles of the cams 11A and 12*a* respectively at appropriate times, so that the rocker arm 13 presses the intake valves 6 and the rocker arm 17 presses the exhaust valves 7. Thus, the intake and exhaust valves 6 and 7 reciprocally move to appropriately open and close their respective combustion-chamber side openings of the intake and the exhaust ports 8 and 9.

Figure 17:
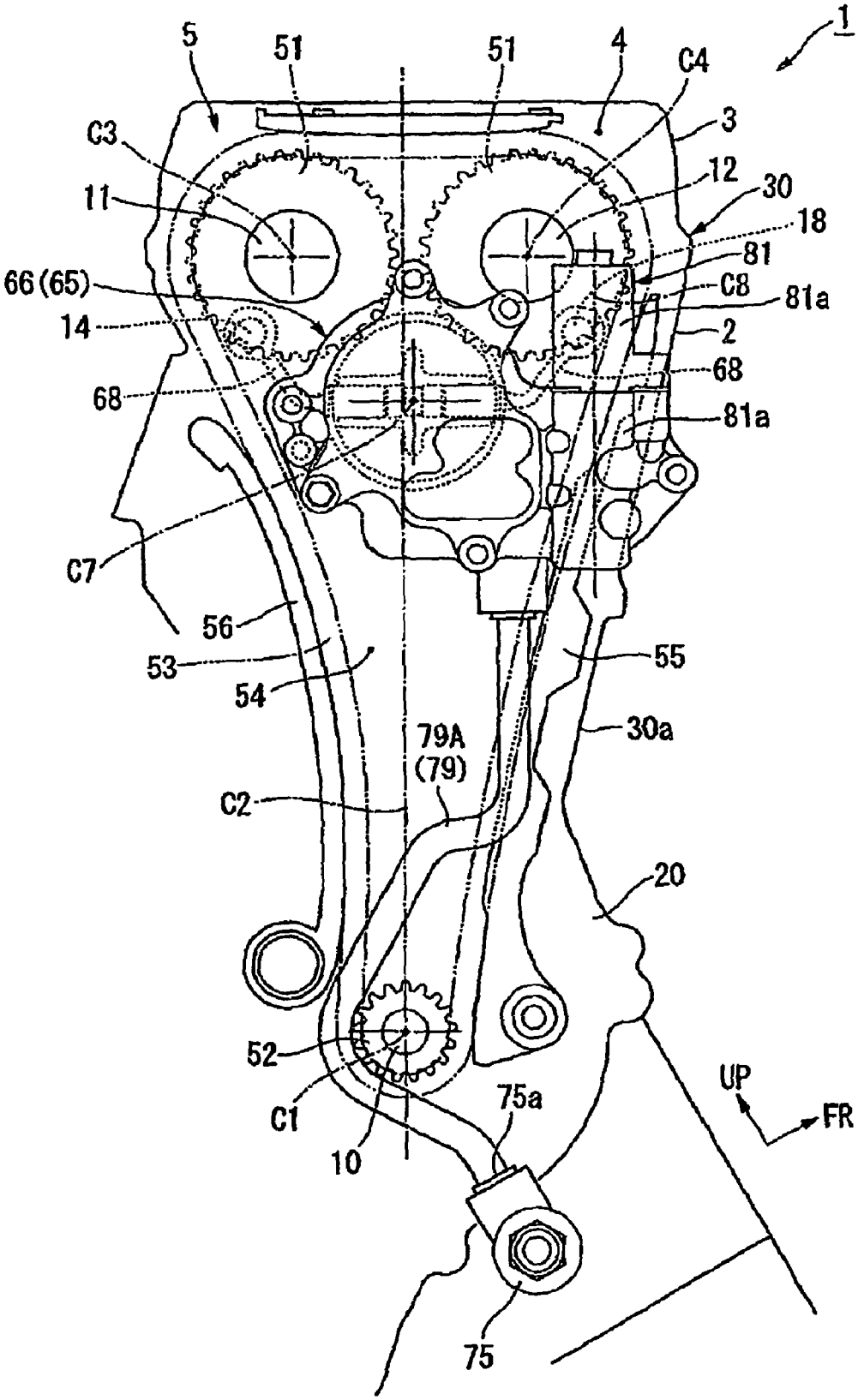
FIG. 17 is a right-side plan view showing a part of the engine where the hydraulic actuator is installed.
Figure 18:
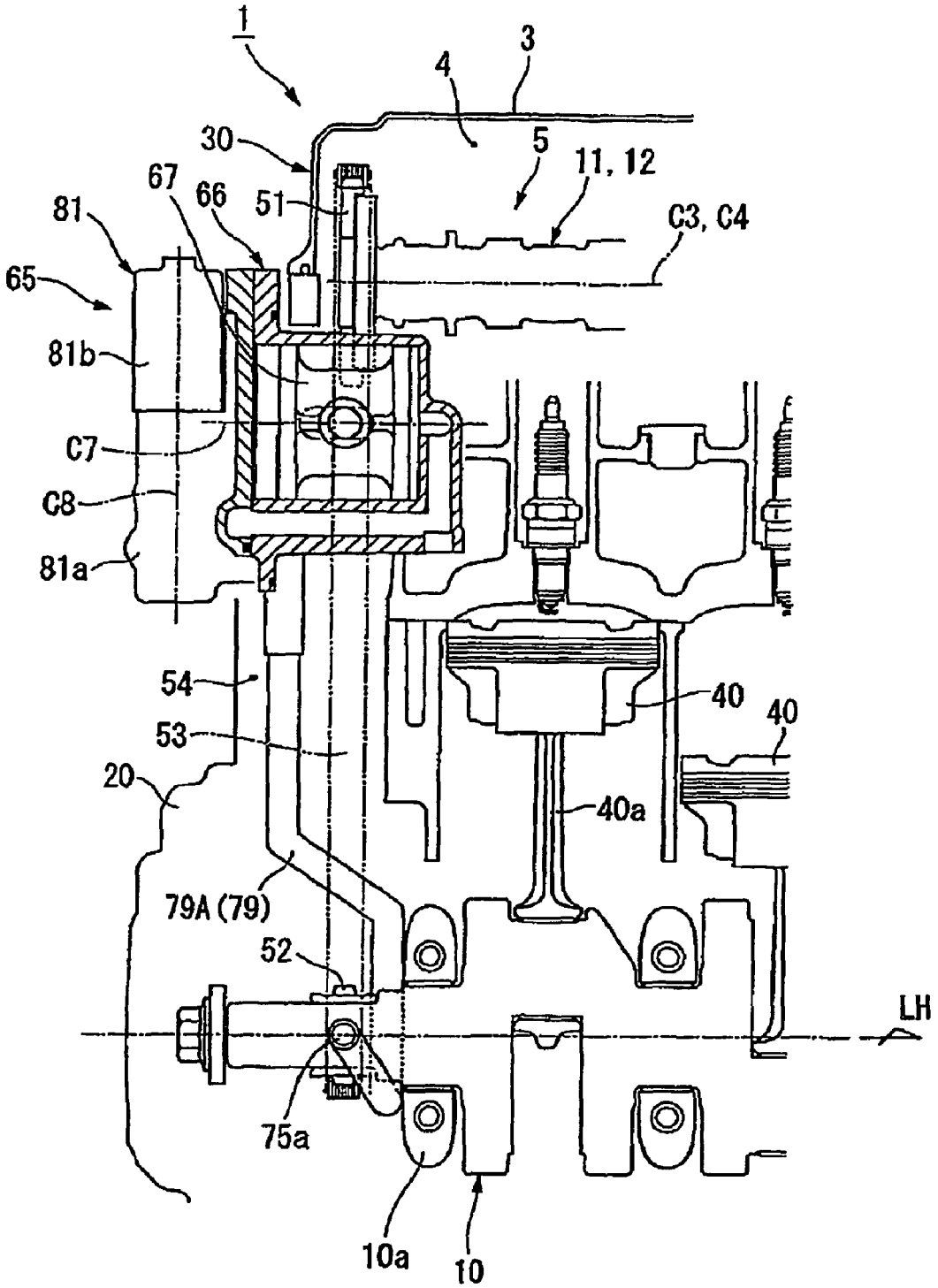
FIG. 18 is a plan view, partially in cross-section, illustrating areas surrounding cylinders of the engine seen from the front side; and areas surrounding the crankshaft seen from below.
Figure 19:
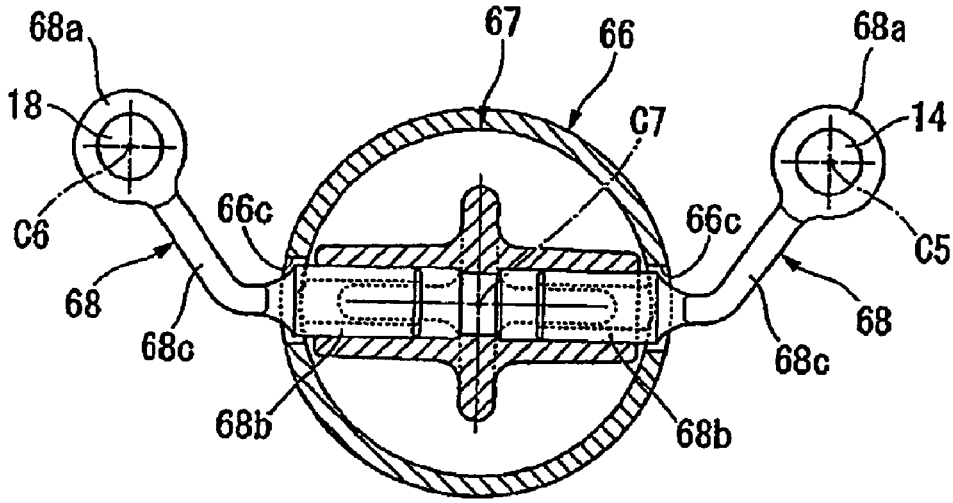
FIG. 19 is a sectional view of a hydraulic cylinder of the hydraulic actuator.

As shown in FIGS. 17 and 18, cam sprockets 51, 51 each having a relatively large diameter, are respectively fixed to the left end portions of the camshafts 11 and 12 so as to be rotatable coaxially and together with their respective camshafts 11 and 12. A crank sprocket (drive sprocket) 52, having a relatively small diameter, is fixed to the left end portion of the crankshaft 10, so as to be rotatable coaxially and together with the crankshaft 10. An endless timing chain 53 is wrapped around these three sprockets 51, 51 and 52. The camshafts 11 and 12 are linked with and driven by the crankshaft 10 by use of the sprockets 51, 51 and 52 as well as the timing chain 53. To accommodate the timing chain 53 and the like, a timing chamber 54 is formed at the left side of the cylinders 30.

A portion of the timing chain 53, located at the front side of the cylinders 30, is the driving side (tension side) that is pulled in by the drive sprocket 52, while the portion located at the rear side of the cylinders 30 is the non-driving side (slack side) that is sent out from the drive sprocket 52. The timing chain 53 is wrapped around the sprockets 51 and 52 along a plane that is orthogonal to the right-and-left direction of this transversely-mounted engine 1.

A timing-chain guide 55 is fixedly provided in a front-side portion of the timing chamber 54. The timing-chain guide 55 slidably contacts the tension side of the timing chain 53 from its front side (i.e., from the outer-circumferential side), and guides the traveling direction of the tension side of the timing chain 53. A tensioner arm (timing-chain tensioner8) 56 is provided in a rear-side portion of the timing chamber 54. The tensioner arm 56 slidably contacts the slack side of the timing chain 53 from its rear side (i.e., from the outer-circumferential side). The tensioner arm 56 thus guides the traveling direction of the slack side of the timing chain 53, and gives an appropriate tension to this side of the timing chain 53 (consequently, the slack of the timing chain 53 can be removed). A lifter mechanism (not shown) is also provided to press the tensioner arm 56 onto the timing chain 53.

The valve mechanism 5 is configured as a variable valve control system that is capable of altering the timings at which the valves 6 and 7 are opened and closed, and is also capable of altering the amount of lift for each of the valves 6 and 7. When the engine is running slowly, such as for example, at an engine speed lower than 6000 rpm (revolutions per minute), the valve mechanism 5 opens and closes the valves 6 and 7 by means of the low-speed cams formed on the corresponding camshafts 11 and 12. On the other hand, when the engine is running fast, for example, at a high engine speed equal to or higher than 6000 rpm (revolutions per minute), the valve mechanism 5 opens and closes the valves 6 and 7 by means of the high-speed cams formed on the corresponding camshafts 11 and 12.

Now, the actions of the valve mechanism 5 are described by taking the intake side of one of the cylinders 30 as an example. Since the configurations of the intake sides of the other cylinders 30 and the configurations of the exhaust sides of the cylinders 30 are similar to the configuration of the example, duplicative redundant descriptions thereof will be omitted.

Now, refer to FIGS. 3A-3B. The cams 11A of the camshaft 11 include left and right first cams 15*a* and 16*a* for low engine speeds; and left and right second cams 15*b* and 16*b* for high engine speeds. In brief, a total of four cams—the left and right first cams 15*a* and 16*a* as well as the left and right second cams 15*b* and 16*b*—are formed on the camshaft 11 for each cylinder 30.

The shape of the left first cam 15*a* is identical to that of the right first cam 16*a*, while the shape of the left second cam 15*b* is identical to that of the right second cam 16*b*. The left first cam 15*a* and the left second cam 15*b* are placed on the left side of the cylinder, and are adjacent to each other in the left-and-right direction of the transversely-mounted engine 1 (in the cam-shaft direction). The right first cam 16*a* and the right second cam 16*b* are placed on the right side of the cylinder, and are adjacent to each other in the left-and-right direction of the transversely-mounted engine 1 (in the cam-shaft direction).

The rocker arm 13 is pivotally supported by the rocker arm shaft 14, and is swingably movable about the rocker axis C5 thereof. The rocker arm 13 is also capable of moving in the axial direction of the rocker arm shaft 14 (i.e., in a direction along the rocker axis C5). The rocker arm 13 is an integrally-formed member that is sufficiently wide in the right-and-left direction of the engine 1 as to cover both of the right and the left intake valves 6. The rocker arm 13 has a right-and-left pair of the cam-contact portions 13*c* that are formed separately from each other in the right-and-left direction of the engine 1. The rocker arm 13 also has a right-and-left pair of the valve-pressing portions 13*d* that are formed, similarly, separately from each other in the right-and-left direction of the engine 1.

While the engine 1 is not in operation or is running at low speed, the rocker arm 13 is located at the leftmost position thereof in the direction of the rocker axis C5, that is, at the limit for the leftward movement of the rocker arm 13 (see FIG. 3A). In this state, the left and right cam-contact portions 13*c* are located respectively under the left and right first cams 15*a* and 16*a*, at such positions that the left and right cam-contact portions 13*c* can slidably contact the outer-circumferential surfaces (cam surfaces) of the left and right first cams 15*a* and 16*a*, respectively.

Each of the right and the left valve-pressing portions 13*d* of the rocker arm 13 is formed wider, in the right-and-left direction (in the direction of the rocker axis C5) than the corresponding one of the right and the left cam-contact portions 13*c*. When the rocker arm 13 is positioned in the above-mentioned limit for the leftward movement, the right and the left valve-pressing portions 13*d* are located at such positions that the right side portions thereof can respectively press the leading-end portions of the stems 6*b* of the right and the left intake valves 6. The position of the rocker arm 13, in the direction of the rocker axis C5, at this time is referred to as a first operation position.

In contrast, while the engine 1 is running at a high speed, the rocker arm 13 is located at the rightmost position in the direction of the rocker axis C5, that is, at the limit for the rightward movement of the rocker arm 13 (see FIG. 3B). In this state, the left and right cam-contact portions 13*c* are located respectively under the left and right second cams 15*b* and 16*b* at such positions that the left and right cam-contact portions 13*c* can slidably contact the outer-circumferential surfaces (cam surfaces) of the left and right second cams 15*b* and 16*b*, respectively.

When the rocker arm 13 is positioned in the above-mentioned limit for the rightward movement, the right and the left valve-pressing portions 13*d* of the rocker arm 13 are located at such positions that they can respectively press the leading-end portions of the stems 6*b* of the right and the left intake valves 6. The position, in the direction of the rocker axis C5, of the rocker arm 13 at this time is referred to as a second operation position.

When the rocker arm 13 is at the first operation position, the rocker arm 13 swings in accordance with the cam profiles of the left and right first cams 15*a* and 16*a*, and thus opens and closes the intake valves 6 by an amount calibrated for low-speed operation. In contrast, when the rocker arm 13 is at the second operation position, the rocker arm 13 swings in accordance with the cam profiles of the left and right second cams 15*b* and 16*b*, and thus opens and closes the intake valves 6 by an amount calibrated for high-speed operation.

Now, refer also to FIG. 2. Each of the first and second cams 15*a*, 16*a*, 15*b*, and 16*b* includes: a cylindrical base face F1 with the cam axis C3 being the center thereof; and a lift face F2 that protrudes at a predetermined position in the rotational direction radially outwards, like a hill, from the circle of the base face F1. Each of the left and right first cams 15*a* and 16*a* has a smaller protruding amount (lift amount) of the lift face F2 than that of each of the left and right second cams 15*b* and 16*b*, respectively. While the base face F1 of each of the cams 15*a*, 16*a*, 15*b*, and 16*b* is being opposed to and is slidably in contact with the corresponding cam-contact portion 13*c* of the rocker arm 13, the corresponding intake valve 6 is closed completely (i.e., the lift amount is zero)—such a state is referred to as a valve-closed state. While the lift face F2 is being opposed to and is slidably in contact with the corresponding cam-contact portion 13*c*, the corresponding intake valve 6 is opened against the biasing force of the valve spring 6*e* by a predetermined amount (i.e., the intake valve 6 is lifted by a predetermined amount)—such a state is referred to as a valve-opened state. Note that the lift amount of each of the first cams 15*a* and 16*a* may be zero (i.e., the first cams 15*a* and 16*b* may be designed as deactivating cams, so that the engine operates with only one respective intake or exhaust valve during low-speed operation thereof).

Figure 4:
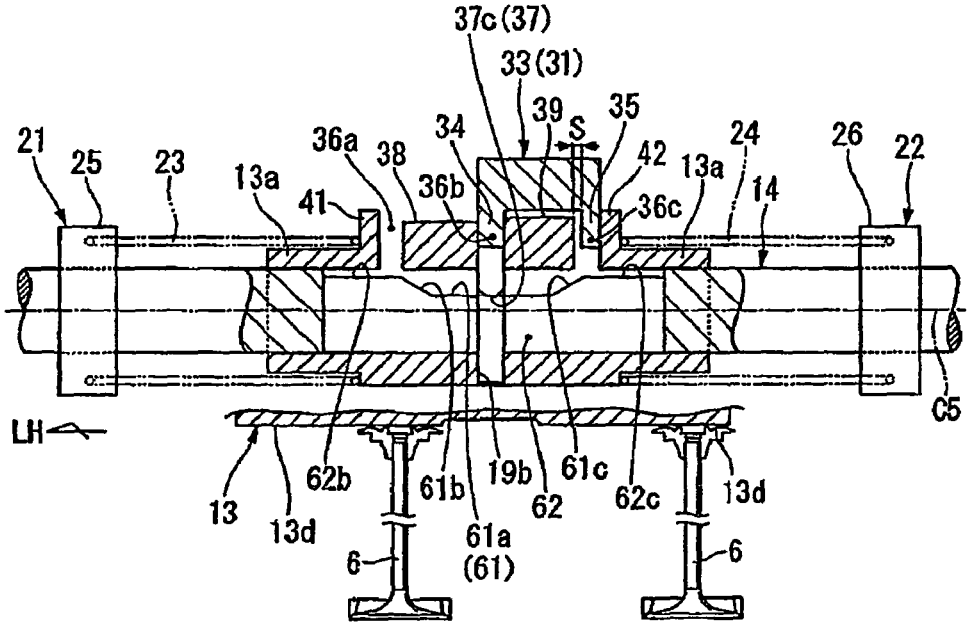
FIG. 4 is a sectional view taken along the axis of an intake-side rocker arm shaft, in the case where the rocker arm is located at the first operation position.

Now, refer to FIGS. 3A, 3B and 4 together. In order to open and close the intake valves 6, the valve mechanism 5 hereof is capable of selectively using either the left and right first cams 15*a* and 16*a* concurrently, or the left and right second cams 15*b* and 16*b*. To this end, the valve mechanism 5 accumulates, in accordance with the engine speed, a force for enabling first and a second rocker arm moving mechanisms 21 and 22, which will be described in detail later, to selectively move the rocker arm 13 in the direction of the rocker axis C5. The valve mechanism 5 uses the accumulated force to move the rocker arm 13 to either the first operation position or the second operation position.

The first rocker arm moving mechanism 21 includes a first spring 23 and a first spring-receiving collar 25. The first spring 23 is positioned at the left side of the left portion of the shaft-insertion boss 13*a* of the rocker arm 13, and exerts force on the left end portion of the shaft-insertion boss 13*a* so as to move the rocker arm 13 from the side of the first operation position (i.e., the low-speed side, shown on the left) to the side of the second operation position (i.e., the high-speed side, shown on the right). The first spring-receiving collar 25 is positioned at the left side of the first spring 23, and is fixedly supported by the outer circumference of the rocker arm shaft 14.

Similarly, the second rocker arm moving mechanism 22 includes a second spring 24 and a second spring-receiving collar 26. The second spring 24 is positioned at the right side of the right portion of the shaft-insertion boss 13*a* of the rocker arm 13, and exerts force on the right end portion of the shaft-insertion boss 13*a* so as to move the rocker arm 13 from the side of the second operation position to the side of the first operation position. The second spring-receiving collar 26 is positioned at the right side of the second spring 24, and is fixedly supported by the outer circumference of the rocker arm shaft 14.

Each of the springs 23 and 24 is a compression spring. The rocker arm shaft 14 is inserted into the springs 23 and 24 so that the springs 23 and 24 can be wrapped around the rocker arm shaft 14 along the outer circumference thereof. The right end portion of the first spring 23 is fitted to the outer circumference of the left end portion of the shaft-insertion boss 13*a*, while the left end portion of the first spring 23 is fitted to the right inner circumference of the first spring-receiving collar 25. On the other side of the boss 13*a*, the left end portion of the second spring 24 is fitted to the outer circumference of the right end portion of the shaft-insertion boss 13*a* of the rocker arm 13, while the right end portion of the second spring 24 is fitted to the left inner circumference of the second spring-receiving collar 26.

The rocker arm shaft 14 is slidably supported by the cylinder head 2, so as to be movable in its axial direction.

While the engine 1 is not in operation or is running at a low engine speed, the rocker arm shaft 14 and the spring-receiving collars 25 and 26 are positioned at their respective limits of leftward movement in the axial direction of the rocker arm shaft 14. Here, the rocker arm 13 is located at the first operation position (see FIG. 3A). The first spring 23 has been subjected to predetermined initial compression, and is provided between the spring-receiving collar 25 and the corresponding portion of the shaft-insertion boss 13*a*. Similarly, the second spring 24 has been subjected to predetermined initial compression and is compressively provided between the spring-receiving collar 26 and the corresponding portion of the shaft-insertion boss 13*a*.

While running as keeping a high engine-speed range (running at a high engine speed), the rocker arm shaft 14 and the spring-receiving collars 25 and 26 are positioned at their respective limits of rightward movement in the axial direction of the rocker arm shaft 14. Here, the rocker arm 13 is located at the second operation position (see FIG. 3B). As described above, the first spring 23 that has been subjected to predetermined initial compression is provided between the spring-receiving collar 25 and the corresponding portion of the shaft-insertion boss 13*a*, while the second spring 24 that has been subjected to predetermined initial compression is compressively provided between the spring-receiving collar 26 and the corresponding portion of the shaft-insertion boss 13*a* of the rocker arm 13.

The rocker arm 13 is moved from one of the operation positions to the other by a predetermined difference between the spring force of the first spring 23 and that of the second spring 24. The difference is caused by slidably moving the rocker arm shaft 14 and the spring-receiving collars 25 and 26 together, in the direction of the rocker axis C5 relative to the cylinder head 2, while a movement-restriction mechanism 31 (which will be described in detail later) restricts the movement of the rocker arm 13 in the direction of the rocker axis C5.

Figure 7A:
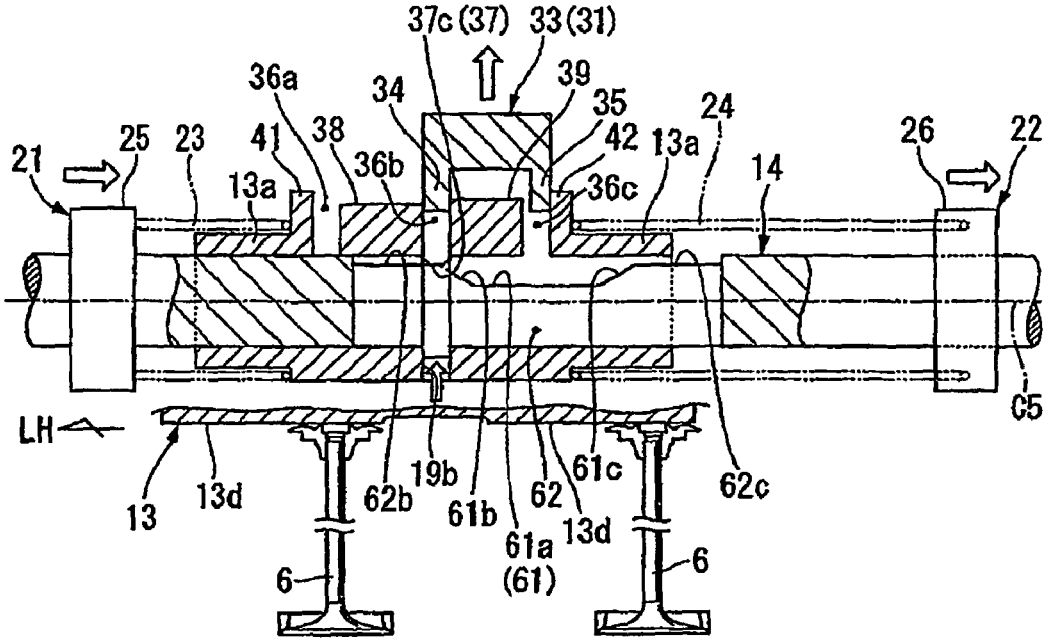
FIG. 7A is a sectional view corresponding to FIG. 4, but illustrating a state where the rocker arm shaft moves in the axial direction from the position shown in FIG. 4, and a force needed for moving the rocker arm is accumulated.

Specifically, we will consider a situation where the rocker arm shaft 14 and the spring-receiving collars 25 and 26 together are moved, from their respective limits of leftward movement, towards the right relative to the cylinder head 2, to their respective limits of rightward movement (see FIG. 7A). In this case, the first spring 23 is compressed further by the amount equivalent to the amount of the rightward movement, so that the spring force of the first spring 23 is increased. In addition, the second spring 24 is stretched, so that the spring force of the second spring 24 is decreased.

Figure 12:
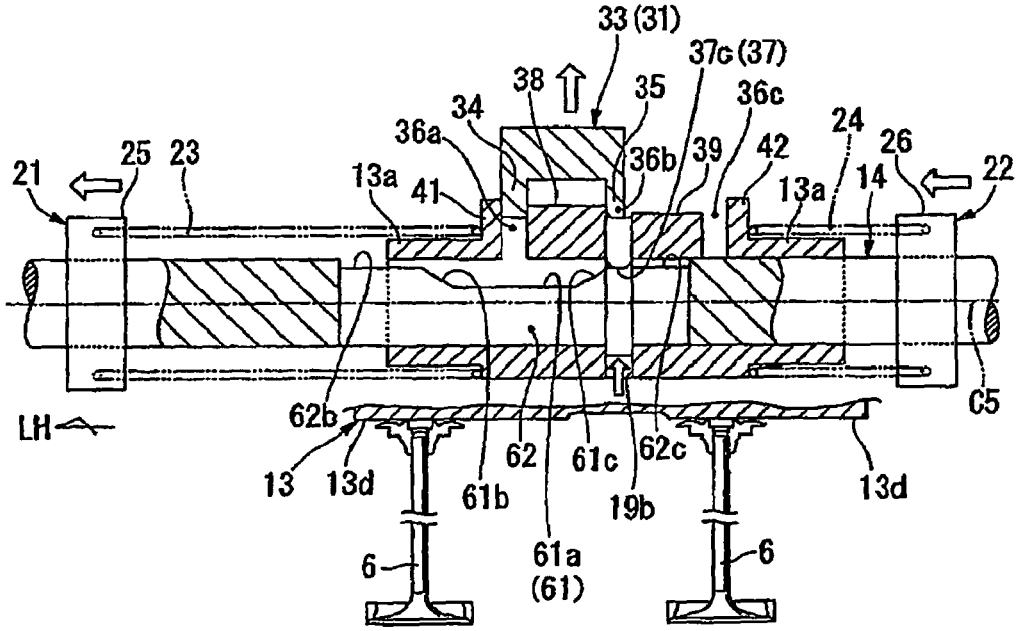
FIG. 12 is a sectional view of the intake-side rocker arm shaft corresponding to FIG. 11 but illustrating a state where the rocker arm shaft moves in the axial direction from its position shown in FIG. 11 and a force needed for moving the rocker arm is accumulated.

Conversely, suppose an alternate situation where the rocker arm shaft 14 and the spring-receiving collars 25 and 26 together are moved from their respective limits of rightward movement towards the left, relative to the cylinder head 2, to their respective limits of leftward movement (see FIG. 12). In this case, the second spring 24 is compressed further by the amount equivalent to the amount of the leftward movement, so that the spring force of the second spring 24 is increased. In addition, the first spring 23 is stretched, so that the spring force of the first spring 23 is decreased.

The difference between the spring forces of the first and second springs 23, 24 (i.e., the spring force accumulated in either one of the springs 23 and 24) enables the rocker arm 13 to move from either one of the operation positions to the other.

Now, refer to FIGS. 3A through 6. The movement-restriction mechanism 31 is configured to temporarily restrict the movement of the rocker arm 13, in the direction of the rocker axis C5, until either one of the springs 23, 24 accumulates a predetermined spring force. The movement-restriction mechanism 31 includes a trigger arm 33 and three engagement grooves 36*a*, 36*b*, and 36*c* formed in an upper surface of the rocker arm 13. The movement-restriction mechanism 31 also includes a pair of left and right deck-like portions 38 and 39, and a trigger pin 37. The trigger arm 33 is supported by a support shaft 32 which is fixed to the cylinder head 2, and which extends parallel to the rocker arm shaft 2. The trigger arm 33 is allowed to pivot about the axis of the support shaft 32, but is not allowed to slide in the axial direction of the support shaft 32.

The three engagement grooves 36*a*, 36*b*, and 36*c*, which are arranged in this order from left side to the right side, are formed in the shaft-insertion boss portion 13*a* of the rocker arm 13. The trigger arm 33 includes a pair of left and right engagement nails 34 and 35, which are configured to be selectively engaged with two of the three engagement grooves 36*a*, 36*b*, and 36*c*. The deck-like portion 38 is formed between the engagement grooves 36*a* and 36*b* while the deck-like portion 39 is formed between the engagement grooves 36*b* and 36*c*. The trigger pin 37 penetrates both the shaft-insertion boss 13*a* of the rocker arm 13 and the rocker arm shaft 14 in a direction that is orthogonal to the rocker axis C5.

Now, refer to FIGS. 2 and 5. The support shaft 32 for the trigger arm 33 is provided above the rocker arm shaft 14, and is located at a position offset towards the outside of the cylinder head 2 (towards a side away from the cylinder axis C2).

Now, refer to FIG. 6. The trigger arm 33 includes: a cylindrical base portion 33*a*; left and right engagement nails 34 and 35; and a connecting wall 33*b*. The support shaft 32 is inserted into the cylindrical base portion 33*a*. The engagement nails 34 and 35 extend from the base portion 33*a* towards the rocker arm shaft 14. The connecting wall 33*b* connects the base-end side portion (i.e., the portion closer to the base portion 33*a*) of the left engagement nail 34 to the base-end side portion of the right engagement nail 35.

Each of the left and right engagement nails 34 and 35 has a thick plate shape, and extends outwardly from the base portion 33*a* in a direction orthogonal to the axial direction of the support shaft 32 (which is also the direction of the rocker axis C5). When viewed in a direction along the direction of the rocker axis C5 (i.e., when viewed in the direction of the rocker axis C5), each of the engagement nails 34 and 35 has a substantially triangular shape, and extends towards the vicinity of the upper-end portion of the rocker arm 13 (see FIG. 5).

The trigger arm 33 is biased towards a side, so that lower-edge portions 34*a* and 35*a* of the left engagement nails 34 and 35 can be pressed, from above, towards the shaft-insertion boss 13*a* (i.e., biased counterclockwise in FIG. 5). When the rocker arm 13 is located at either one of the operation positions, the left and right engagement nails 34 and 35 are put into the corresponding two of the three engagement grooves 36*a*, 36*b*, and 36*c* until the leading ends of the engagement nails 34 and 35 nearly reach the bottoms of the corresponding grooves 36*a*, 36*b*, and 36*c*. This state of the trigger arm 33 is referred to as the installed state of the trigger arm 33.

In this engaged state, the sliding movement of the rocker arm 13 in the axial, direction of the rocker axis C5 is impossible. However, when the trigger arm 33 is pivotally moved outwardly away from the rocker arm 13, thereby disengaging the left and right engagement nails 34 and 35 from the corresponding engagement grooves 36*a*, 36*b*, and 36*c*, the rocker arm 13 is then allowed to slide in the direction of the rocker axis C5.

Figure 6A:
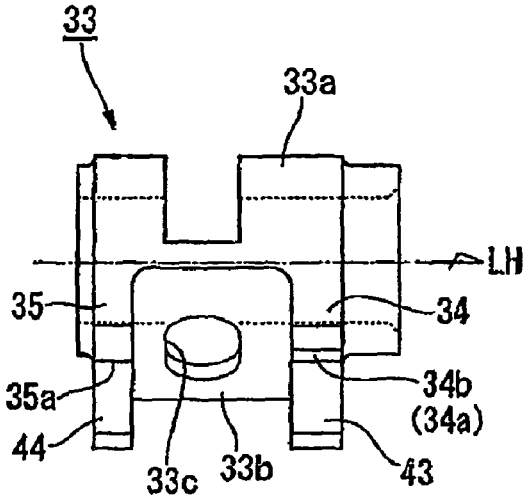
FIG. 6A is a front plan view of a trigger arm, that restricts movement of the rocker arm between the operation positions.
Figure 6B:
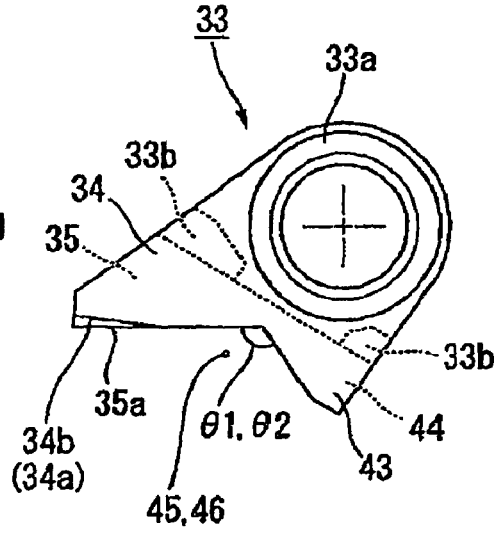
FIG. 6B is a left-side plan view of the trigger arm.

Now, refer to FIGS. 5 and 6A-6B. Each of the lower-edge portions 34*a* and 35*a* of the left and right engagement nails 34 and 35 is formed as an end face that is parallel to the axial direction of the support shaft 32. When viewed in the direction of the rocker axis C5, the shape of the lower-edge portion 34*a* differs from that of the lower-edge portion 35*a*.

The deck-like portions 38 and 39 have upper-end portions 38*a* and 39*a*, respectively, which are positioned near the upper-end of the shaft-insertion boss 13*a*. Each of the upper-end portions 38*a* and 39*a* is formed as an end face that is parallel to the direction of the rocker axis C5. When viewed in the direction of the rocker axis C5, the shape of the upper-end portion 38*a* differs from that of the upper-end portion 39*a*. The differences in shape between the engagement nails 34 and 35 as well as between the deck-like portions 38 and 39 result in different timings to disengage the engagement nails 34 and 35 from the engagement grooves 36*a*, 36*b*, and 36*c*.

Now, refer to FIGS. 3A, 3B and 4. The left engagement nail 34 has a width in the direction of the rocker axis C5 (i.e., the thickness of the engagement nail 34) which is larger (wider) than that of the right engagement nail 35. The widths of the engagement grooves 36*a*, 36*b*, and 36*c* in the direction of the rocker axis C5 are large enough to allow the left engagement nail 34 to engage with any one of these engagement grooves 36*a*, 36*b*, and 36*c* (i.e., the engagement grooves 36*a*, 36*b*, and 36*c* are formed as wide as the left engagement nail 34).

Suppose a state where the left engagement nail 34 engages with the central engagement groove 36*b* and the right engagement nail 35 engages with the right engagement groove 36*c* (i.e., the rocker arm 13 is located at the first operation position; see FIGS. 3A and 4). In this state, the right sidewall of the right engagement nail 35 gets closer to (almost contacts) the right inner sidewall of the right engagement groove 36*c*, and a predetermined gap S is left between the left sidewall of the right engagement nail 35 and the left inner sidewall of the right engagement groove 36*c*.

Figure 11:
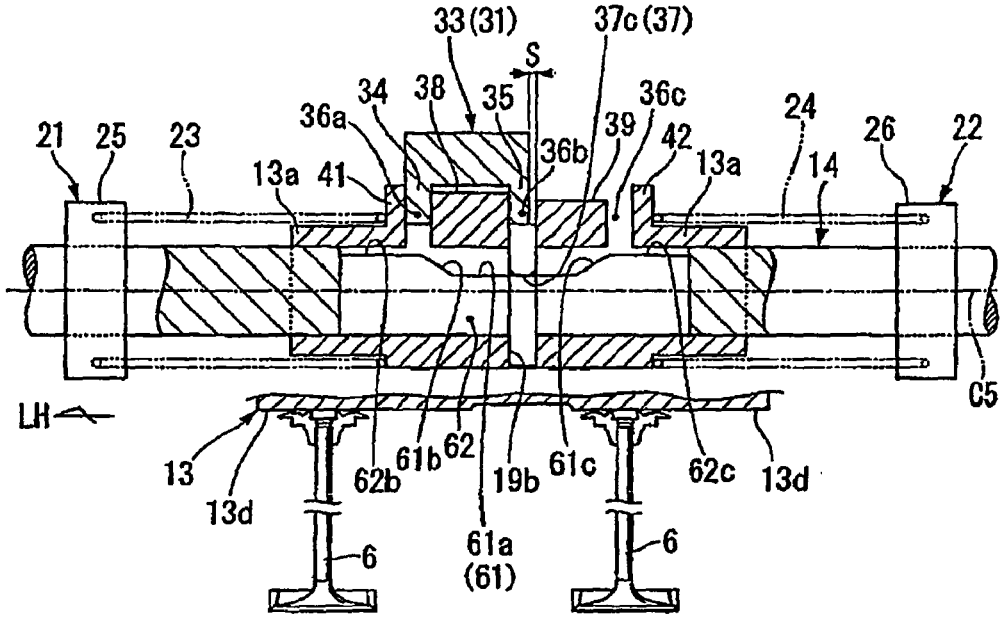
FIG. 11 is a sectional view taken along the axis of an intake-side rocker arm shaft in the case where the rocker arm is located at the second operation position.

In contrast, suppose a state where the left engagement nail 34 engages with the left engagement groove 36*a* and the right engagement nail 35 engages with the central engagement groove 36*b* (i.e., the rocker arm 13 is located at the second operation position; see FIGS. 3B and 11). In this state, the left sidewall of the right engagement nail 35 gets closer to (almost contacts) the left inner sidewall of the central engagement groove 36*b*, and a predetermined gap S of the same amount as the above-mentioned one is left between the right sidewall of the right engagement nail 35 and the right inner sidewall of the central engagement groove 36*b*.

Figure 7B:
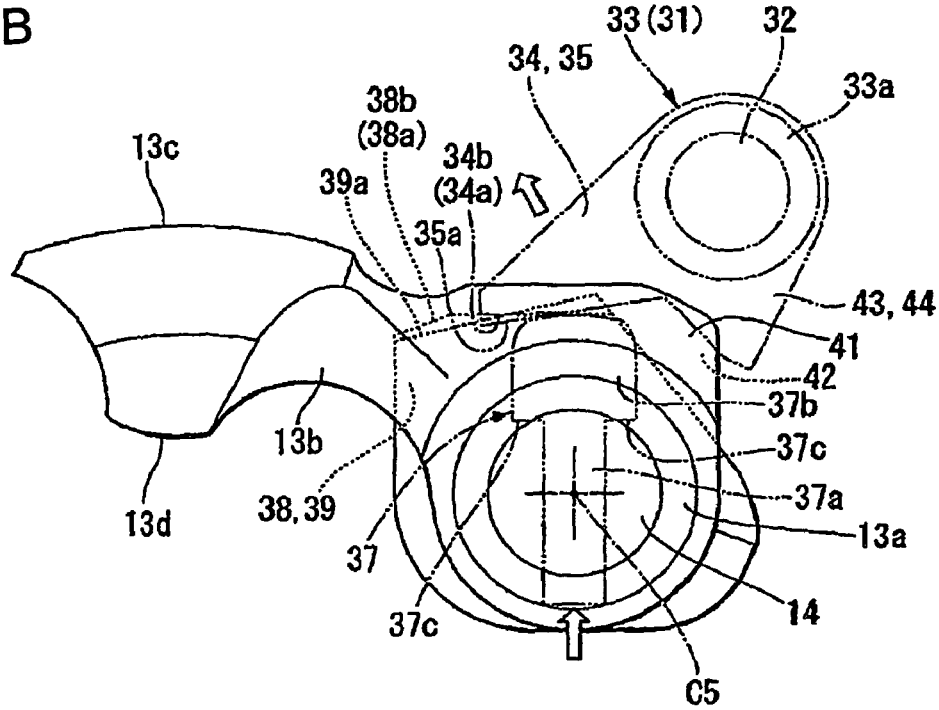
FIG. 7B is a left-side plan view of the rocker arm, corresponding to FIG. 5 but illustrating the state shown in FIG. 7A.

Now, refer to FIGS. 7A-7B. When the axial movement of the rocker arm shaft 14 makes the trigger pin 37 act (detailed descriptions of the action of the trigger pin 37 will be given later), the trigger arm 33 comes to be in a state of primary swing state in which the trigger arm 33 swings from its position to the opposite side of the rocker arm 13 by a predetermined amount. The primary swing state is accomplished before the rocker arm 13 opens the valves 6. In this primary swing state, when viewed in the direction of the rocker axis C5, the lower-edge portions 34*a* and 35*a* of the engagement nails 34 and 35 overlap the upper-end portions 38*a* and 39*a* of the deck-like portions 38 and 39 by predetermined amounts (i.e., the engagement nails 34 and 35 engage respectively with the corresponding ones of the engagement grooves 36*a*, 36*b*, and 36*c*). Such overlapping restricts the movement of the rocker arm 13 in the direction of the rocker axis C5.

Figure 8:
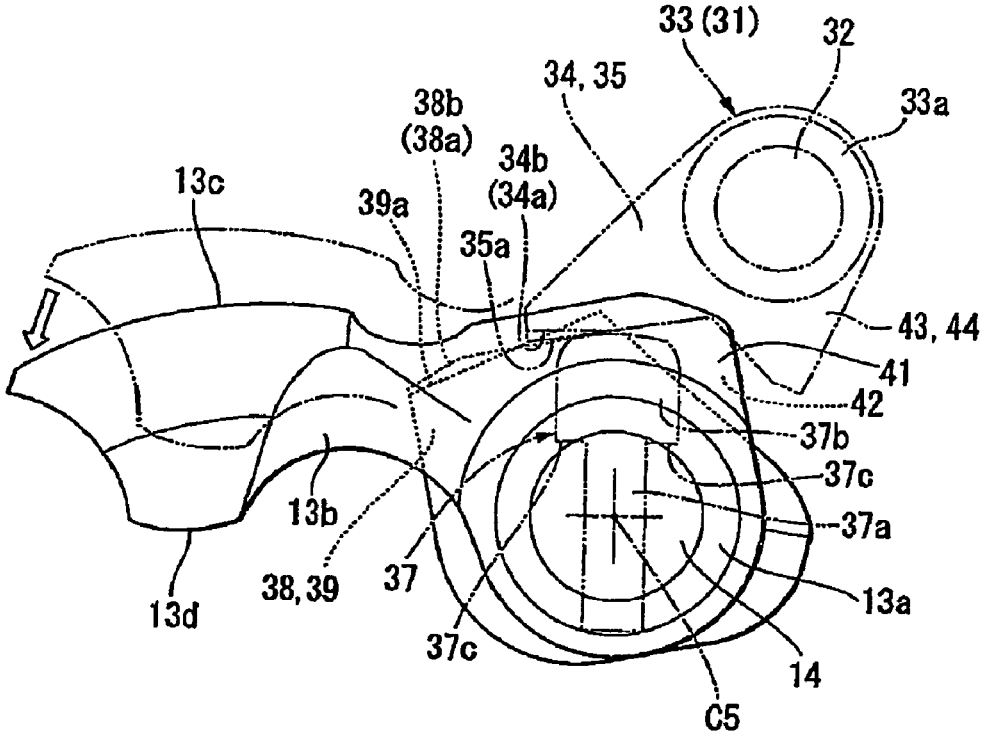
FIG. 8 is a left-side plan view of the rocker arm corresponding to FIG. 5 but illustrating the rocker arm in a valve opening state.
Figure 9A:
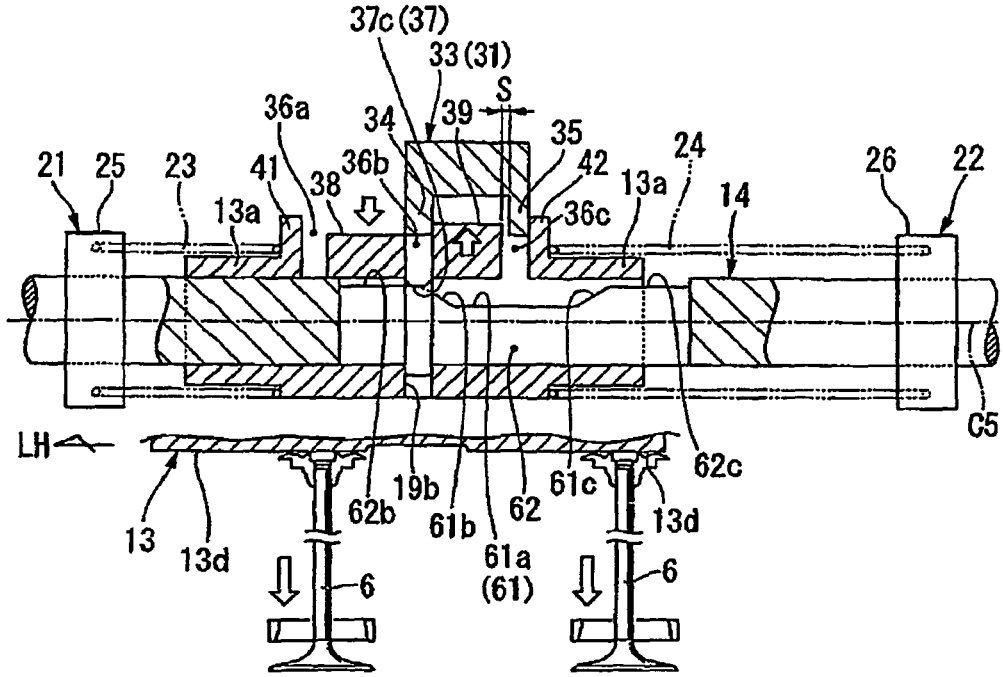
FIG. 9A is a sectional view of the intake-side rocker arm shaft corresponding to FIG. 4 but illustrating the valve opening state shown in FIG. 8.

Suppose that while the trigger arm 33 is in the primary swing state, the rocker arm 13 swings and lifts the valves 6 (see FIGS. 8 and 9A). The rotation of the shaft-insertion boss 13*a*, along with the swing of the rocker arm 13, lowers down the upper-end portion 38*a* of the left deck-like portion 38 that is adjacent to the left engagement nail 34. Consequently, when viewed in the direction of the rocker axis C5, the overlapping margin of the upper-end portion 38*a* and the lower-edge portion 34*a* of the left engagement nail 34 disappears (i.e., the engagement nail 34 and the central engagement groove 36*b* are disengaged). Meanwhile, the upper-end portion 39*a* of the right deck-like portion 39 that is adjacent to the right engagement nail 35 is raised up a little. This means that, when viewed in the direction of the rocker axis C5, there still remains an overlapping margin of the right engagement nail 35 and the right deck-like portion 39 (i.e., the engagement of the engagement nail 35 and the right engagement groove 36*c* is maintained).

Figure 9B:
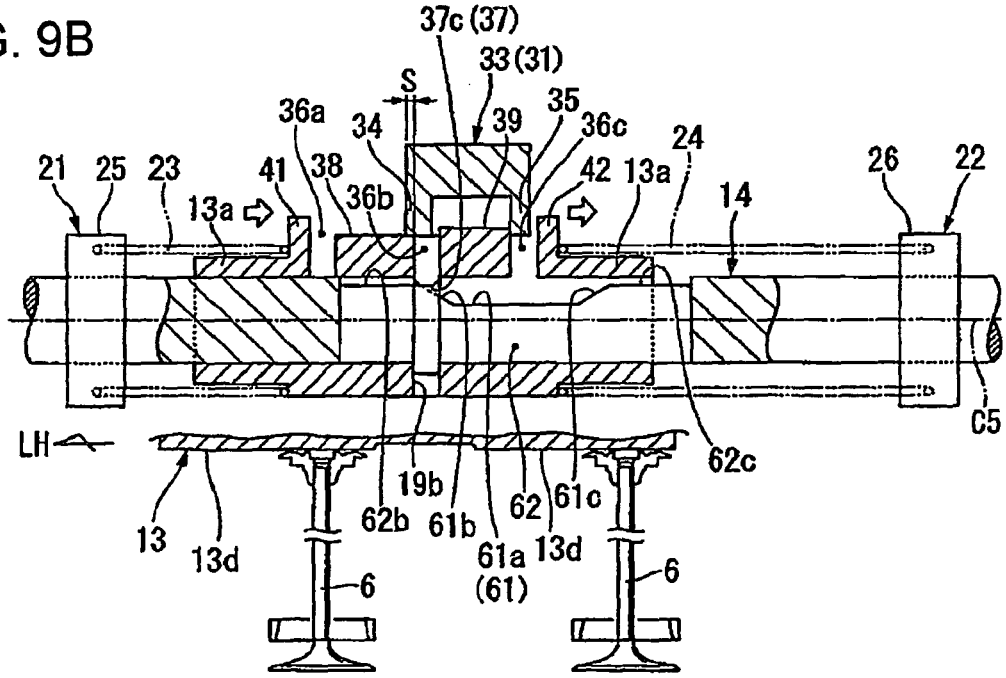
FIG. 9B is a sectional view of the intake-side rocker arm shaft corresponding to FIG. 4 but illustrating a state where the rocker arm moves in the axial direction by an amount equivalent to a gap S from its position shown in FIG. 9A.

In this state, a force that is given to the rocker arm 13 by either of the rocker arm movement mechanisms 21 and 22 makes the rocker arm 13 slide by an amount equivalent to the gap S between the right engagement nail 35 and either one of the right and the central engagement grooves 36*c* and 36*b*. Consequently, the lower-edge portion 34*a* of the left engagement nail 34 is supported on top of the upper-end portion 38*a* of the left deck-like portion 38 by an amount equivalent to the gap S (see FIG. 9B).

Figure 10A:
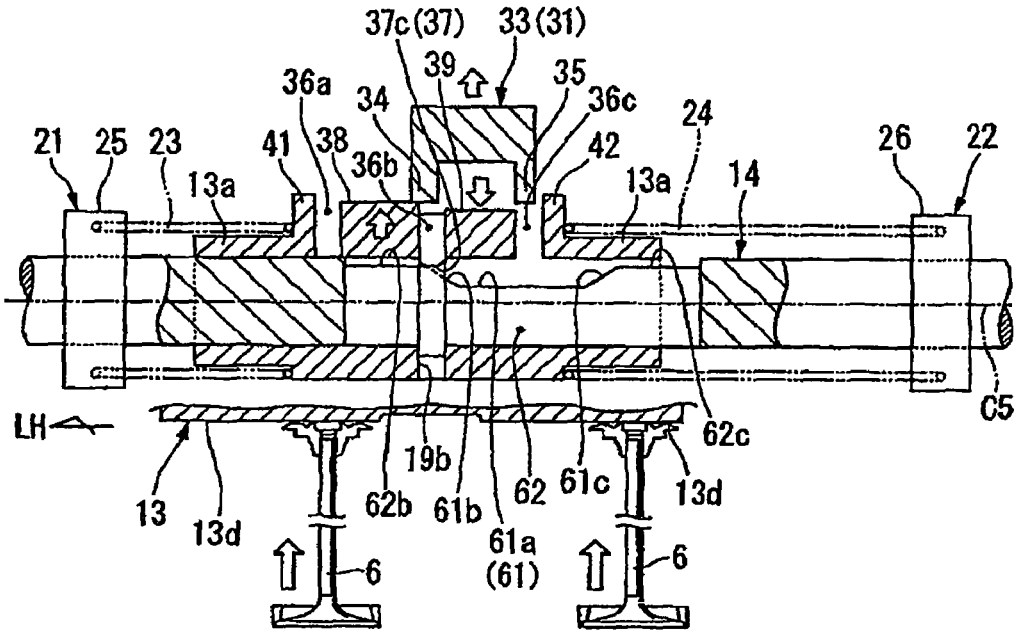
FIG. 10A is a sectional view of the intake-side rocker arm shaft corresponding to FIG. 4 but illustrating the rocker arm in a valve closing state.
Figure 10B:
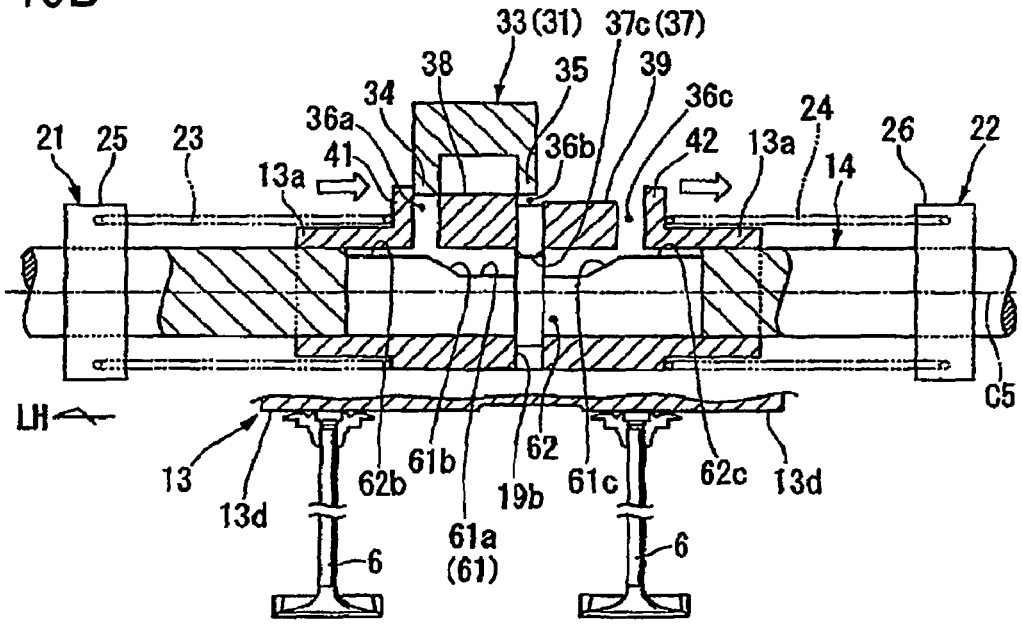
FIG. 10B is a sectional view of the intake-side rocker arm shaft corresponding to FIG. 4 but illustrating a state where the rocker arm is moving to the second operation position.

Then, in the above-described state, a swing of the rocker arm 13 to a side so as to close the valves 6 allows the upper-end portion 38*a* of the lowered-down left deck-like portion 38 to be raised up and the raised-up upper-end portion 39*a* of the right deck-like portion 39 is lowered down. Then, not only the left engagement nail 34 but also the trigger arm 33 as a whole swings further to the opposite side to the rocker arm 13 (see FIG. 10A). Consequently, when viewed in the direction of the rocker axis C5, the overlapping margin of the upper-end portion 39*a* of the right deck-like portion 39 and the lower-edge portion 35*a* of the right engagement nail 35 disappears (i.e., the engagement nail 35 and the right engagement groove 36*c* are disengaged). Such disengagement allows the rocker arm 13 to slide from either one of the operation positions to the other (see FIG. 10B).

Now, refer to FIGS. 5 and 6. The lower-edge portions 34*a* and 35*a* of the left and right engagement nails 34 and 35 of the trigger arm 33 are formed with their respective base-end sides (the sides closer to the base portion 33*a*) overlapping each other when viewed in the direction of the rocker axis C5. The leading-end side of the lower-edge portion 35*a* of the right engagement nail 35 is formed to be flat so that the leading-end side and the base-end side can form a single plane. The leading-end side of the lower-edge portion 34*a* of the left engagement nail 34 is formed obliquely upwards so that the leading-end side is gradually narrowing down from the base-end side. An oblique face 34*b* is thus formed. At the time when the engagement of the right engagement nail 35 is disengaged from the right deck-like portion 39, the oblique face 34*b* comes to be substantially parallel with and be brought into contact with a contact face 38*b* of the left deck-like portion 38. Detailed descriptions of the contact face 38*b* will be given later.

Now, refer to FIGS. 4 and 5. When viewed in the direction of the rocker axis C5, each of the left and right deck-like portions 38 and 39 of the rocker arm 13 protrudes from the shaft-insertion boss 13*a* towards the base-end side of the arm portion 13*b* so as to form a substantially trapezoidal shape. When viewed in the direction of the rocker axis C5, the upper-end portion 39*a* of the right deck-like portion 39 is formed to be flat and extend in the direction of the tangential line to the shaft-insertion boss 13*a*.

When viewed in the direction of the rocker axis C5, the upper-end portion 38*a* of the left deck-like portion 38 is formed obliquely relative to the upper-end portion 39*a* of the right deck-like portion 39. The protruding amount from the shaft-insertion boss 13*a* is gradually decreasing towards the side closer to the trigger arm 33, and is gradually increasing towards the side farther away from the trigger arm 33. Accordingly, the upper-end portions 38*a* and 39*a* of the left and right deck-like portions 38 and 39 intersect each other when viewed in the direction of the rocker axis C5.

In the upper-end portion 38*a* of the left deck-like portion 38, the end portion farther away from the trigger arm 33 is cut away so as to be a chamfer when viewed in the direction of the rocker axis C5. Accordingly, the end portion is obliquely shaped, so that the farther a portion is located away from the trigger arm 33, the more the protruding amount from the shaft-insertion boss 13*a* is decreased. The entire upper-end portion 38*a* of the left deck-like portion 38 is bent and is formed in a chevron shape when viewed in the direction of the rocker axis C5.

The upper-end portion 38*a* of the left deck-like portion 38 is formed as a mount face to be continuously in contact with the lower-edge portion 34*a* of the left engagement nail 34 since the lower-edge portion 34*a* of the left engagement nail 34 is supported on the upper-end portion 38*a*, until when the swing of the rocker arm 13 after the surmounting of the lower-edge portion 34*a* makes the left engagement nail 34 (trigger arm 33) swing to the opposite side to the rocker arm 13 and the swing of the left engagement nail 34 (trigger arm 33) disengages the right engagement nail 35 from the right deck-like portion 39.

In the upper-end portion 38*a* of the left deck-like portion 38, the side closer to the trigger arm 33 is formed as a relatively-large flat portion (commonly-used portion). This larger flat portion is the place to be continuously in contact with the lower-edge portion 34*a* of the left engagement nail 34, since the lower-edge portion 34*a* of the left engagement nail 34 is supported on top of the left deck-like portion 34 until the left engagement nail 34 (trigger arm) swings to the opposite side to the rocker arm 13 so as to disengage the right engagement nail 35 from the right deck-like portion 39.

In addition, in the upper-end portion 38*a* of the left deck-like portion 38, the side farther away from the trigger arm 33 is formed as a relatively small flat portion. When the right engagement nail 35 is disengaged from the right deck-like portion 39, this smaller flat portion serves as the contact face 38*b* that, when viewed in the direction of the rocker axis C5, is substantially parallel with and is brought into contact with the leading-end side (the oblique face 34*b*) of the lower-edge portion 34*a* of the left engagement nail 34. Accordingly, fine adjustment of the timing when the right engagement nail 35 is completely disengaged from the right deck-like portion 39 (and even the cam-switching timing) requires only the changing of the height or the like of this relatively-small contact face 38*b*.

Now, refer to FIGS. 3A-3B, 4, and 5. A left limit flange 41 and a right limit flange 42 are formed respectively in a left portion and in a right portion of the shaft-insertion boss 13*a* of the rocker arm 13. When the trigger arm 33 is disengaged, either one of the left and right limit flanges 41 and 42 is brought into contact with the trigger arm 33, so as to restrict the sliding movement of the rocker arm 13 within a predetermined distance.

Each of the left and right limit flanges 41 and 42 extents orthogonally to the direction of the rocker axis C5, and has a thick plate shape. When viewed in the direction of the rocker axis C5, each of the left and right limit flanges 41 and 42 protrudes upwardly from the shaft-insertion boss 13*a* so as to form a rectangular shape. Each of the left and right limit flanges 41 and 42 protrudes at a position, in the circumferential direction of the shaft-insertion boss 13*a*, that is a little closer to the trigger arm 33 than the position of the left and right deck-like portions 38 and 39. When viewed in the direction of the rocker axis C5, the left limit flange 41 has a shape that is identical to the shape of the right limit flange 42. In addition, when viewed in the direction of the rocker axis C5, the limit flanges 41 and 42 are larger than the left and right deck-like portions 38 and 39. The left limit flange 41 is formed by extending the shaft-insertion boss 13*a* upwardly adjacent the left inner sidewall of the left engagement groove 36*a* so as to form a single plane. The right limit flange 42 is formed by extending the shaft-insertion boss 13*a* upwardly adjacent the right inner sidewall of the right engagement groove 36*c* so as to form a single plane.

Now, refer to FIG. 4. While the rocker arm 13 is located at the first operation position, the right sidewall of the trigger arm 33 (i.e., the right sidewall of the right engagement nail 35) nearly contacts the right inner sidewall of the right engagement groove 36*c* (and the right sidewall of the right limit flange 42). In the meanwhile, the gap S is left between the left inner sidewall of the right engagement groove 36*c* and the left sidewall of the right engagement nail 35. In addition, the two sidewalls of the left engagement nail 34 of the trigger arm 33 nearly contact the two respective inner sidewalls of the central engagement groove 36*b*.

Now, refer to FIG. 11. While the rocker arm 13 is located at the second operation position, the left sidewall of the trigger arm 33 (i.e., the left sidewall of the left engagement nail 34) nearly contacts the left inner sidewall of the left engagement groove 36*a* (and the left sidewall of the left limit flange 41). In the meanwhile, the right sidewall of the left engagement nail 34 nearly contacts the right inner sidewall of the left engagement groove 36*a*. In addition, the gap S is left between the right sidewall of the trigger arm 33 (i.e., the right sidewall of the right engagement nail 35) and the right inner sidewall of the central engagement groove 36*b*. Moreover, the left sidewall of the right engagement nail 35 nearly contacts the left inner sidewall of the central engagement groove 36*b*.

Now, refer to FIGS. 5 and 6A-6B. Left and right protruding pieces 43 and 44 are formed on the trigger arm 33. Like the left and right engagement nails 34 and 35, the left and right protruding pieces 43 and 44 are brought into contact respectively with the left and right limit flanges 41 and 42, but are formed as separate bodies respectively from the left and right engagement nails 34 and 35.

The left and right protruding pieces 43 and 44 are positioned below the left and right engagement nails 34 and 35, and extend outwardly from the base portion 33*a* of the trigger arm 33 towards the rocker arm shaft 14 so that, when viewed in the direction of the rocker axis C5, the set of the left and right protruding pieces 43 and 44 and the set of the left and right engagement nails 34 and 35 cooperate to form a V-shape. Both the left and right protruding pieces 43 and 44 have thick plate shapes. The left protruding piece 43 and the left engagement nail 34 together form a single plane while the right protruding piece 44 and the right engagement nail 35 together form a single plane. When viewed in the direction of the rocker axis C5, each of the left and right protruding pieces 43 and 44 has a substantially triangular shape, with a protruding amount that is smaller than the protruding amount of each of the left and right engagement nails 34 and 35. In addition, when viewed in the direction of the rocker axis C5, the left protruding piece 43 has an identical shape to that of the right protruding piece 44.

The base-end side (the side closer to the base portion 33*a*) of the left protruding piece 43 and that of the left engagement nail 34 are contiguously formed while the base-end side of the right protruding piece 44 and that of the right engagement nail 35 are also contiguously formed. A cut-away portion 45 is formed between the left protruding piece 43 and the left engagement nail 34. In addition, a cut-away portion 46 is formed between the right protruding piece 44 and the right engagement nail 35. When viewed in the direction of the rocker axis C5, each of the cut-away portions 45 and 46 is recessed so as to form a chevron shape (V-shape) while the side facing the rocker arm shaft 14 of each of the cut-away portions 45 and 46 is the open side. To put it differently, the left protruding piece 43 and the left engagement nail 34 are formed respectively on the two sides of the cutaway portion 45 by forming the cut-away portion 45 in the middle section of a single plate-shaped member. Likewise, the right protruding piece 44 and the right engagement nail 35 are formed respectively on the two sides of the cutaway portion 46 by forming the cut-away portion 46 in the middle section of a single plate-shaped member.

When viewed in the direction of the rocker axis C5, the protruding pieces 43 and 44 have identical shapes, and the cut-away portions 45 and 46 have identical shapes. In addition, when viewed in the direction of the rocker axis C5, the vertex angles of the cut-away portions 45 and 46 (denoted by θ1 and θ2, respectively) are obtuse angles. The connecting wall 33*b*, which has a thick plate shape, is formed, in parallel with the direction of the rocker axis C5, in the vicinities of the vertices θ1 and θ2 to connect the left and right engagement nails 34 and 35 as well as to connect the left and right protruding pieces 43 and 44. A hole 33*c* is formed in a central portion of the connecting wall 33*b* by removing a portion of the wall 33*b* when the trigger arm 33 is formed. The formation of the hole 33*c* enables the trigger arm 33 to have a lighter weight.

Figure 15:
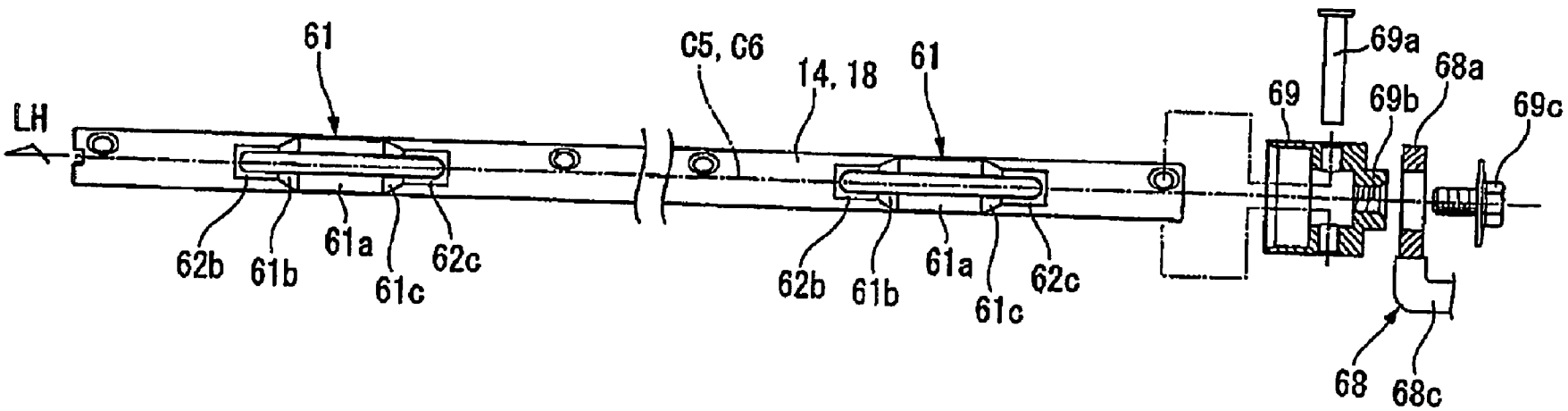
FIG. 15 is an exploded top plan view illustrating the rocker arm shaft and associated hardware.
Figure 16:
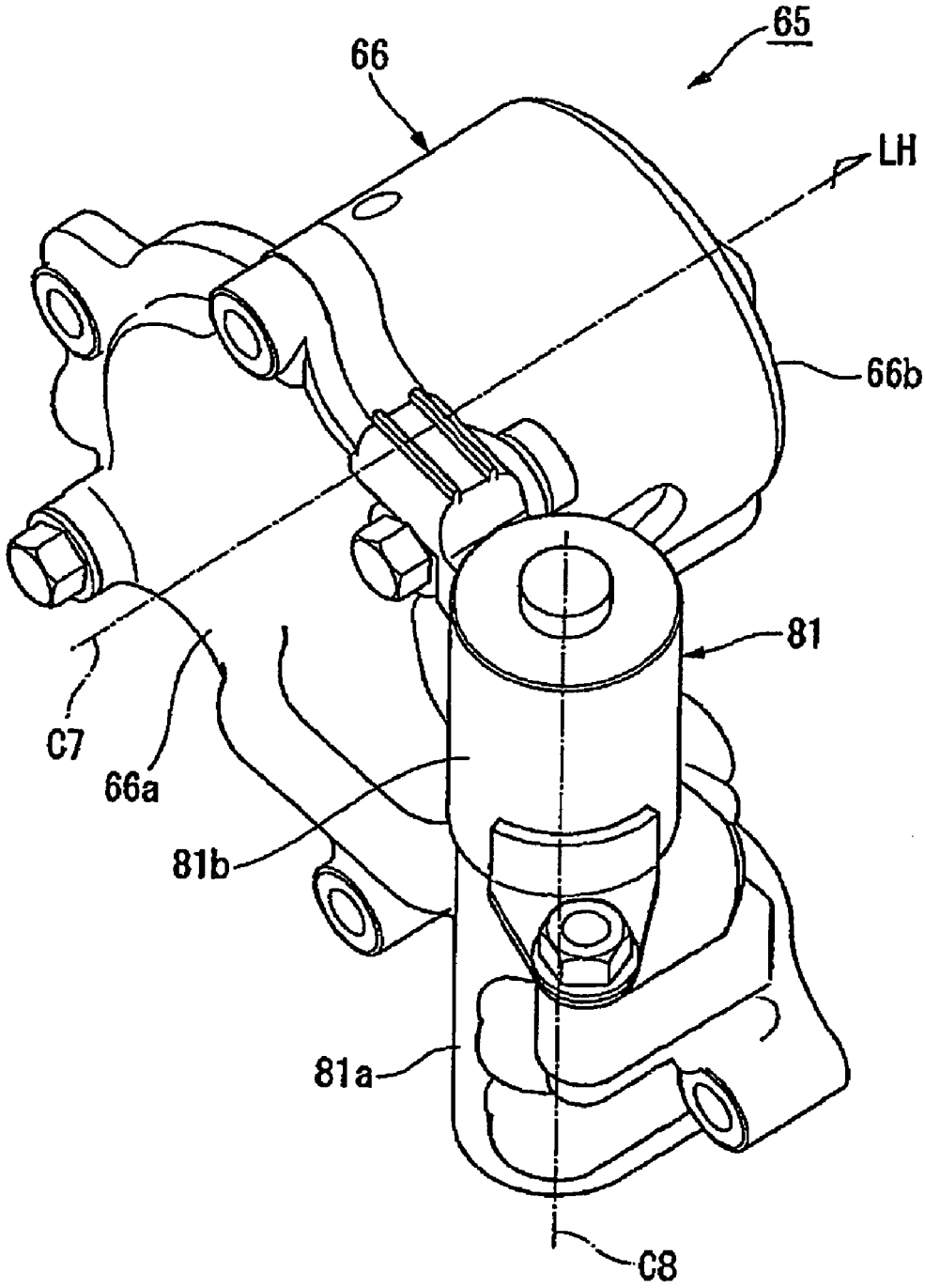
FIG. 16 is a perspective view of a hydraulic actuator for moving the rocker arm shaft in the axial direction.

Now, refer to FIGS. 4 and 15. Once the rocker arm shaft 14 has been inserted into the shaft-insertion boss 13*a* of the rocker arm 13, a portion of the rocker arm shaft 14 stays inside the shaft-insertion boss 13*a*. A cut-away recessed portion 61 is formed in the outer circumference on the upper side of the above-mentioned portion inside the shaft-insertion boss 13*a*. The cut-away recessed portion 61 extends in the direction of the rocker axis C5 over a predetermined distance. The cut-away recessed portion 61 includes: a bottom face 61*a*; and left and right slopes 61*b* and 61*c*. The bottom face 61*a* is flat and parallel with the direction of the rocker axis C5. The left and right slopes 61*b* and 61*c* are respectively formed contiguously from the two ends, in the direction of the rocker axis C5, of the bottom face 61*a*, and extend obliquely upwards relative to the bottom face 61*a*. The width (length), in the direction of the rocker axis C5, of the bottom face 61*a* is larger than the width, in the direction of the rocker axis C5, of each of the left and right slopes 61*b* and 61*c*.

A long, slit-shaped through-hole 62 is formed in the rocker arm shaft 14. The through-hole 62 extends in the direction of the rocker axis C5, and penetrates, from top to bottom, the rocker arm shaft 14 in a direction that is orthogonal to the rocker axis C5. The through-hole 62 is formed at a position located substantially at the center of the width, in the direction orthogonal to the rocker axis C5, of the cut-away recessed portion 61. The through-hole 62 is longer than the entire length, in the direction of the rocker axis C5, of the cut-away recessed portion 61. Left and right flat faces 62*b* and 62*c* are formed respectively at the outer sides, in the direction of the rocker axis C5, of the cut-away recessed portion 61. The left flat faces 62*b* and 62*c* extend, in parallel with the rocker axis C5, contiguously from the left slope 61*b* and the right slope 61*c*, respectively. Each of the flat faces 62*b* and 62*c* covers the end portion, and also its surrounding area, of the through-hole 62 located at the outer side, in the direction of the rocker axis C5, of the cut-away recessed portion 61.

The trigger pin 37 is inserted into the through-hole 62, and is held there.

Now, refer to FIGS. 4 and 5. The trigger pin 37 is a thick plate-shaped member that extends in a direction orthogonal to the direction of the rocker axis C5. The width (thickness), in the direction of the rocker axis C5, of the trigger pin 37 is approximately the same as that of each of the engagement grooves 36*a*, 36*b*, and 36*c* (which is also approximately the same as the thickness of the engagement nail 34). The trigger pin 37 includes an inserting portion 37*a* and a wider portion 37*b*. The inserting portion 37*a* has a strip shape, and is inserted into the through-hole 62 from above. The inserting portion 37*a* is held in the through-hole 62 so as to be movable in the direction of the rocker axis C5, but not to be rotatable, relative to the through-hole 62, about the rocker axis C5. The wider portion 37*b* is formed at the upper-end side of the inserting portion 37*a*. The width, in the direction orthogonal to the rocker axis C5, of the wider portion 37*b* is extended both towards the front side and towards the rear side so as to make the wider portion 37*b* wider both than the inserting portion 37*a* and than the through-hole 62.

The top portion of the wider portion 37*b* has a curved arc shape when viewed in the direction of the rocker axis C5. The wider portion 37*b* has a front-side and rear-side pair of bottom-side portions located at the two sides of the inserting portion 37*a*. The bottom-side portions extend straight along the direction orthogonal to the rocker axis C5. The two bottom-side portions of the wider portion 37*b* are referred to as supported portions 37*c* because these portions are designed to be brought into contact, from above, with: the bottom face 61*a* of the cut-away recessed portion 61; the left and right slopes 61*b* and 61*c* of the cut-away recessed portion 61; and the left and right flat faces 62*b* and 62*c*. With the two supported portions 37*c*, the trigger pin 37 is supported by the rocker arm shaft 14. The supported portions 37*c* prevents the trigger pin 37 from dropping downwards off the through-hole 62, but allows the trigger pin 37 to move upwards.

While the engine 1 is running at either a low speed or a high speed, the supported portions 37*c* of the trigger pin 37 are supported on top of a substantially central portion, in the direction of the rocker axis C5, of the bottom face 61*a* of the cut-away recessed portion 61 (see FIGS. 4 and 11). At this time, the upper portion of the wider portion 37*b* and the lower portion of the inserting portion 37*a* protrude out to the outer-circumferential sides of the rocker arm shaft 14.

An upper fitting hole 19*a* is formed in the bottom of the central engagement groove 36*b* formed in the shaft-insertion boss 13*a* of the rocker arm 13. The upper fitting hole 19*a* is capable of being inserted into and fitted to by the upper portion of the wider portion 37*b* (see FIG. 3). A lower fitting hole 19*b* is formed in a radially-opposite portion of the shaft-insertion boss 13*a* to the upper fitting hole 19*a*. The lower fitting hole 19*b* is capable of being inserted into and fitted to by the lower portion of the inserting portion 37*a* (see FIG. 4).

The upper portion and the lower portion of the trigger pin 37 are inserted into and fitted to the upper and the lower fitting holes 19*a* and 19*b*, respectively. Accordingly, the trigger pin 37 is movable, together with the rocker arm 13, in the direction of the rocker axis C5 relative to the rocker arm shaft 14. In addition, the trigger pin 37 is prevented from leaning, that is, displacing either its upper portion or its lower portion in the direction of the rocker axis C5. The rotation of the trigger pin 37 about its own up-and-down direction axis is also prevented. Note that, if the width of each of the upper and the lower fitting holes 19*a* and 19*b* is formed to have a larger width in the front-to-rear direction, the trigger pin 37 and the rocker arm shaft 14 are rotatable is C5 relative to each other.

Suppose a state in which the rocker arm 13 is located at either one of the two operation positions and the two supported portions 37*c* are supported on top of the substantially central portion of the bottom face 61*a*. In addition, suppose that, in this state, while the movement-restriction mechanism 31 restricts the movement, in the direction of the rocker axis C5, of the rocker arm 13, a hydraulic actuator 65, which will be described later, makes the rocker arm shaft 14 move in the direction of the rocker axis C5. Then, the two supported portions 37*c* are supported on top of either one of the left and right slopes 61*b* and 61*c* located at the two sides of the bottom face 61*a*. Thus the trigger arm 33 moves upwards in the orthogonal direction to the rocker axis C5.

Either of the left and right engagement nails 34 and 35 of the trigger arm 33 enters, from above, the central engagement groove 36*b*, and thus engages with the central engagement groove 36*b*. The lower-edge portions 34*a* and 35*a* are brought into contact with the top portion of the wider portion 37 of the trigger pin 37. In this state, a rise of the trigger pin 37 makes the trigger arm 33 swing by a predetermined amount to a side so as to disengage one of the engagement nails 34 and 35 from the central engagement groove 36*b*, and eventually with the rocker arm 13.

Now, refer to FIGS. 17 and 18. In the cylinder head 2, the hydraulic actuator 65 is provided in a right side portion that the right end portions of the rocker arm shafts 14 and 18 are opposed to. The hydraulic actuator 65 is configured to selectively move the rocker arm shafts 14 and 18 in the direction of the rocker axis C5.

The hydraulic actuator 65 includes a hydraulic cylinder 66, which is arranged with an axis C7 thereof substantially parallel to the axial direction of the rocker arm shafts 14 and 18. The hydraulic cylinder 66 is disposed at a position between the rocker arm shafts 14 and 18 so as to extend across the timing chamber 54, located inside the right side portion of the cylinder head 2, in the right-and-left direction.

A plunger 67 is provided inside the hydraulic cylinder 66, and a pair of front-and-rear operation elements 68 extend, respectively, from the two side faces of the plunger 67. The operation elements 68 are made to engage respectively with the right end portions of the rocker arm shafts 14 and 18, and thus the rocker arm shafts 14 and 18 are made to move simultaneously, by a single stroke of the plunger 67, in the direction of the rocker axis C5.

Now, refer to FIG. 15. An end collar 69, which has a cylindrical shape with a bottom, is fixed to the right end portion of each of the rocker arm shafts 14 and 18 by means of a pin 69*a* that is inserted into the end collar 69 orthogonally to the direction of the rocker axis C5. A protruding portion 69*b* is formed on the outer side of the bottom of each end collar 69. A ring portion 68*a* is formed in the leading-end portion of each operation element 68. The ring portions 68*a* of the operation elements 68 are fitted respectively to the protruding portions 69*b* of each end collar 69. Each of the ring portions 68*a* and the corresponding one of the protruding portions 69*b* thus fitted to each other are rotatable relative to each other. A flanged bolt 69*c* is fastened to the outer side of the protruding portion 69*b* of each end collar 69, so that the corresponding ring portion 68*a* is assembled to the end collar 69 (rocker arm shaft 14 or 18), while not allowed to move in the direction of the rocker axis C5. Note that each operation element 68 may be fixed to the end collar 69 by any suitable connector. For example, if, as in the above-described example, a fastening member is used, the ring portion 68*a* may be fitted to a male-threaded portion formed in the corresponding end collar 69, and fixed with a nut. Alternatively, each operation element 68 may be riveted to the corresponding end collar 69.

As in the case of the second spring-receiving collar 26, the right end portion of the second spring 24 is fitted to the inner circumference of the left side of the end collar 69. To put it differently, the end collar 69 functions also as the second spring-receiving collar 26 for the cylinder 30 located at the outermost right side of all the cylinders 30 of the engine 1.

Figure 20:
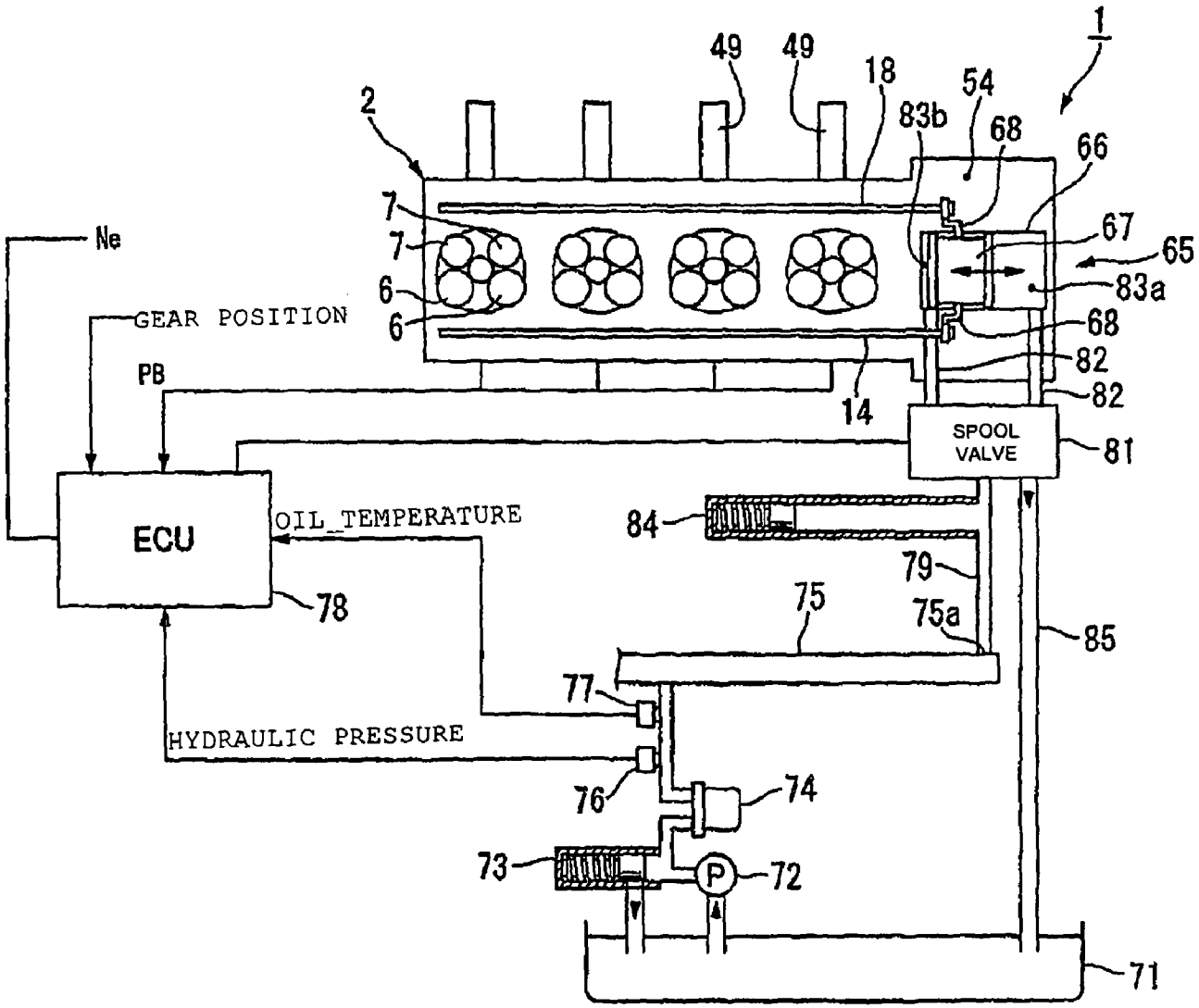
FIG. 20 is a simplified schematic diagram illustrating the configuration of a valve mechanism for the engine.

Now, refer to FIG. 20. An oil pump 72 is provided in a lower portion of the engine 1. The oil pump 72 pumps out the engine oil stored in an oil pan 71. Hydraulic pressure is supplied by the oil pump 72 to an oil gallery 75 through a relief valve 73 and an oil filter 74.

The oil gallery 75 that extends in the direction in which the cylinders 30 are arranged (i.e., in the vehicle-width direction) is disposed approximately right below the crankshaft 10 (that is, the oil gallery 75 extends in parallel with the crankshaft 10). The oil gallery 75 supplies the engine oil to the crankshaft bearing and the like in an appropriate manner. A hydraulic-pressure sensor 76 and an oil-temperature sensor 77 are provided in an oil passage connecting the oil pump 72 to the oil gallery 75. The signals detected by these sensors 76 and 77 are inputted into an ECU 78 that is configured to control the operation of the engine 1 as a whole. The information detected by the hydraulic-pressure sensor 76 is used for detecting any malfunction of the hydraulic-pressure supply system, if such malfunction occurs.

An oil supply hole 75*a* is formed in the right end portion of the oil gallery 75. An oil channel 79 extends from the oil supply hole 75*a* to a spool valve 81 of the hydraulic actuator 65. The operation of the spool valve 81 is controlled by the ECU 78, and the spool valve 81 switches the hydraulic routes so as to switch, in accordance with the engine speed (Ne), the gear position or the like, the cams used for opening and closing the valves 6 and 7.

The spool valve 81 enables the hydraulic pressure from the oil channel 79 to be selectively supplied, via either of two oil passages 82 to the corresponding one of oil chambers 83*a* and 83*b* that are located respectively on the two sides of the hydraulic cylinder 66. When hydraulic pressure is supplied from the oil pump 72, via this spool valve 81, selectively to either of the oil chambers 83*a* and 83*b*, the plunger 67 gives a stroke so as to move the rocker arm shafts 14 and 18 simultaneously in the axial direction.

Accordingly, each of the rocker arm shafts 14 and 18 thus moves from a present one of the two limit positions for the leftward and the rightward movements to the other. Consequently, either one of the first and the second rocker arm moving mechanisms 21 and 22 has a force that is large enough to make the rocker arm 13 slide from one of the operation positions to the other.

FIG. 20 also shows an accumulator 84 that is provided in the oil channel 79 and a hydraulic-pressure returning passage 85 extending from the spool valve 81 back to the oil pan 71. In addition, the vacuum inside the intake pipe (PB) is detected for each of the cylinders 30 to detect operation failure, and the information thus obtained is inputted into the ECU 78.

Now, refer to FIGS. 16 to 19. The hydraulic actuator 65 includes: the hydraulic cylinder 66 that has a cylindrical shape with a bottom; the plunger 67 which is coaxially installed in the hydraulic cylinder 66 and which is capable of giving strokes; a plate-shaped cover 66*a* that is used for closing the opening side of the hydraulic cylinder 66; and the spool valve 81 that is provided integrally with a side of the cover 66*a*.

A flange is formed on the opening side of the hydraulic cylinder 66, and the outer-circumferential portion of the cover 66*a* is fixed, together with the flange of the hydraulic cylinder, to a right side portion of the cylinder head 2 by means of bolts or the like. Accordingly, most of the hydraulic cylinder 66 is placed inside the cylinder head 2, resulting in a reduction in the amount by which the hydraulic cylinder 66 sticks out to the outside of the cylinder head 2 (outside of the engine 1).

The hydraulic cylinder 66 is placed so that its axial center (represented by an axis C7) can be close to the cylinder axis C2 when viewed from a side of the engine 1. The spool valve 81 has a cylindrical appearance that extends in the up-and-down direction. The spool valve 81 is placed so that the axial center of the spool valve 81 (represented by the axis C8) can be orthogonal to the axis C7 of the hydraulic cylinder 66 and can be substantially parallel with the cylinder axis C2.

The spool valve 81 includes a casing 81*a*. The casing 81, which forms the lower portion of the spool valve 81, is formed integrally with a side of the cover 66*a*. Inside the casing 81*a*, a plunger capable of switching hydraulic routes is installed so as to be allowed to give strokes. A solenoid 81*b* forms the upper portion of the spool valve 81, and makes the plunger give strokes to switch hydraulic routes.

When viewed from a side of the engine 1 (i.e., when viewed in the direction of the axis C7 of the hydraulic cylinder 66), the spool valve 81 is placed at the front side of the hydraulic cylinder 66 so as to avoid the hydraulic cylinder 66. Thus achieved is a reduction in the amount by which the spool valve 81 sticks out to the outside of the cylinder head 2 (outside of the engine 1).

Now, refer to FIG. 21. The plunger 67 includes disc-shaped seal members 67*a* and 67*b*, which are provided on the two sides of the plunger 67 (i.e., the side closer to the cover 66*a* and the side closer to a bottom portion 66*b*), in the direction of the axis C7. The seal members 67*a* and 67*b* slidably contact the inner wall of the hydraulic cylinder 66. The oil chamber 83*a* is formed between the seal member 67*a* and the cover 66*a* of the hydraulic cylinder 66, while the oil chamber 83*b* is formed between the seal member 67*b* and the bottom portion 66*b*.

No oil chamber is formed in the middle section, in the direction of the axis C7, of the hydraulic cylinder 66 and of the plunger 67. In the middle section, ellipsoidal insertion holes 66*c* are formed in the two side portions, in the radial direction, of the hydraulic cylinder 66. Base portions 68*b* of the operation elements 68 are inserted through the insertion holes 66*c*, from the outside of the hydraulic cylinder 66 into the inside thereof, and are attached respectively to the two sides of the plunger 67, in the radial direction thereof.

Each operation element 68 includes the base portion 68*b*, an arm portion 68*c*, and the ring portion 68*a*. The base portion 68*b* has a circular-shaft shape, and is inserted into either one of the two sides, in the radial direction, of the plunger 67. The arm portion 68*c* extends from the outer end of the base portion 68*b* and bends towards the bottom portion 66*b* of the hydraulic cylinder 66. The arm portion 68*c* then extends obliquely upwards to a side so as to be separated away from the hydraulic cylinder 66. The ring portion 68*a* is formed in the leading-end portion of the arm portion 68*c*.

When the engine 1 is mounted on the vehicle, the hydraulic cylinder 66 and the plunger 67 are placed so that their axial direction can be substantially horizontal. Air-purge grooves 86*a* and 86*b* are formed respectively in the outer circumferences of the upper portions of the seal members 67*a* and 67*b* of the plunger 67. While the plunger 67 is giving a stroke, the air-purge grooves 86*a* and 87*a* are used for purging the air inside the oil chambers 83*a* and 83*b*, respectively.

When viewed from the top of the plunger 67, each of the air-purge grooves 86*a* and 86*b* is formed to have a Y-shape. A pair of air-purge holes 87*a* and 87*b* are drilled in upper portions of the hydraulic cylinder 66. The air-purge hole 87*a* is formed on the side closer to the cover 66*a*, and the air-purge hole 87*b* is formed on the side closer to the bottom portion 66*b*. The air-purge grooves 86*a* and 87*a* correspond respectively to the air-purge holes 87*a* and 87*b*.

Figure 21A:
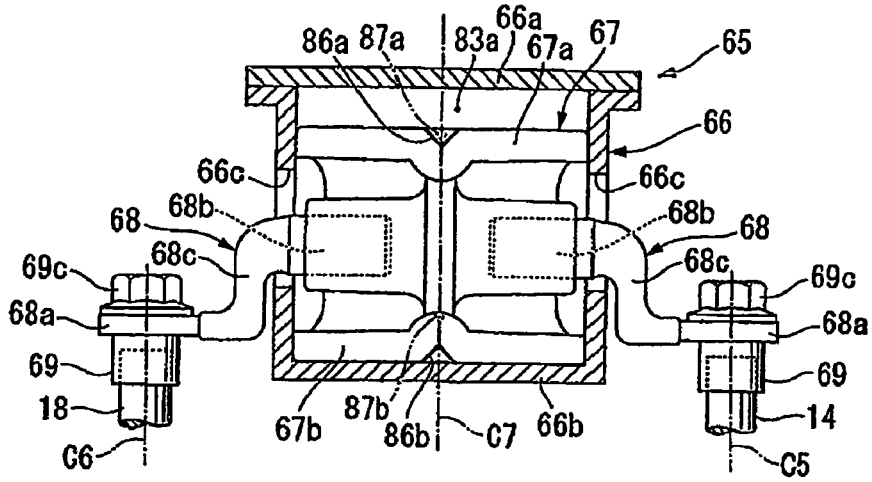
FIG. 21A is a cross-sectional view of the hydraulic cylinder illustrating an air purging operation of the hydraulic cylinder, a state where the plunger has given a complete stroke.
Figure 21B:
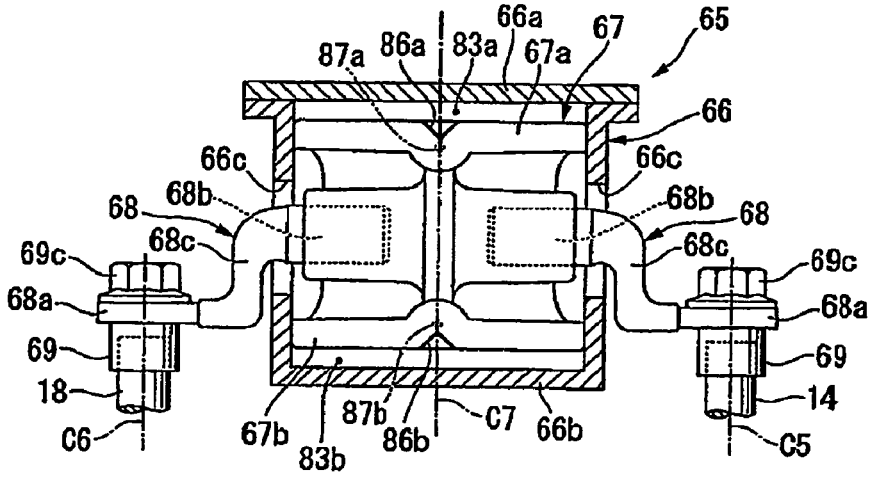
FIG. 21B is a cross-sectional view similar to FIG. 21A, showing a state where the plunger is in the course of giving a stroke.

Suppose, for example, that the plunger 67 has given a complete stroke towards the bottom portion 66*b* of the hydraulic cylinder 66 (see FIG. 21A). In this state, the air-purge hole 87*b* on the side closer to the bottom portion 66*b* is located at a position offset towards the cover 66*a* from the single leg portion of the air-purge groove 86*b* on the same side, that is, on the side closer to the bottom portion 66*b*. The air-purge hole 87*a* on the side closer to the cover 66*a* is positioned between the branched arm portions of the air-purge groove 86*a* on the same side, that is, on the side closer to the cover 66*a*. Each of the oil chambers 83*a* and 83*b* is thus kept in an oil-tight state.

Figure 21C:
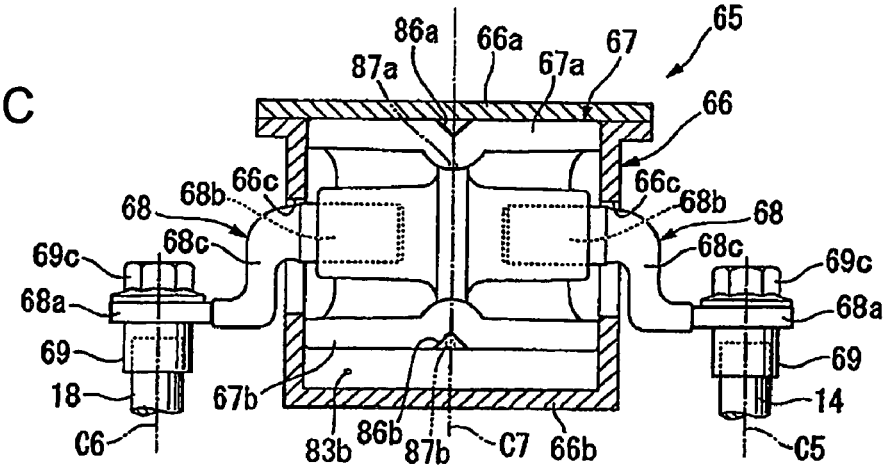
FIG. 21C is a d cross-sectional view similar to FIG. 21A, showing the air purging of the hydraulic cylinder, in a state where the plunger has given a complete stroke.

Likewise, suppose that the plunger 67 has given a complete stroke towards the cover 66*a* of the hydraulic cylinder 66 (see FIG. 21C). In this state, the air-purge hole 87*b* on the side closer to the bottom portion 66*b* is positioned between the branched arm portions of the air-purge groove 86*b* on the same side, that is, on the side closer to the bottom portion 66*b*. The air-purge hole 87*a* on the side closer to the cover 66*a* is located at a position offset towards the bottom portion 66*b* from the single leg portion of the air-purge groove 86*a* on the same side, that is, on the side closer to the cover 66*a*. Each of the oil chambers 83*a* and 83*b* is thus kept in an oil-tight state.

Suppose that the plunger 67 that has been given a complete stroke towards either one of the bottom portion 66*b* and the cover 66*a* starts to give another stroke towards the other. Then, while the plunger 67 is giving the new stroke, the air-purge holes 87*a* and 87*b* are laid respectively over the single leg portions of the air-purge grooves 86*a* and 86*b* (see FIG. 21B). The leading ends of the branched arm portions of the air-purge groove 86*a* are opened to the oil chamber 83*a* while the leading ends of the branched arm portions of the air-purge groove 86*b* are opened to the oil chamber 83*b*. The air which has intruded into the oil chambers 83*a* and 83*b* and which remains in the upper-end portions of the oil chambers 83*a* and 83*b* is discharged out of the hydraulic cylinder 66 respectively via the air-purge groove 86*a* and then the air-purge hole 87*a* as well as via the air-purge groove 86*b* and then the air-purge hole 87*b*.

The hydraulic cylinder 66 is placed so that its portion located on the side closer to the bottom portion 66*b* in the axial direction can be laid over the right end portions of the rocker arm shafts 14 and 18. To put it differently, the hydraulic cylinder 66 is partially placed inside the cylinder head 2 until its portion located on the side closer to the bottom portion 66*b* in its axial direction is laid over the right end portions of the rocker arm shafts 14 and 18. Such a placement results in a reduction in the amount by which the hydraulic actuator 65 sticks out to the outside of the cylinder head 2.

Now, refer to FIGS. 17 and 18. The oil supply hole 75*a* formed in the right portion of the oil gallery 75 is located at the right side of the crankshaft 10, and is located right below but a predetermined distance away from the drive sprocket 52. The oil supply hole 75*a* is opened to the upper side, that is, opened towards the drive sprocket 52 (i.e., crankshaft 10).

When viewed in the up-and-down direction, the oil supply hole 75*a* is placed within an projection area of the crankshaft 10 (i.e., within the width, in the radial direction, of the crankshaft 10). The oil channel 79 connecting the oil supply hole 75*a* to the hydraulic actuator 65 includes a pipe 79A. The pipe 79A has a circular cross section, and extends inside the timing chamber 54 while avoiding the crankshaft 10, the cam chains 53, and the like. For the sake of convenience, the portion around the crank shaft 10 is illustrated in FIG. 18 as seen from below while the side closer to the cylinders 30 is illustrated in FIG. 18 as seen, from the front side, in the direction orthogonal to the cylinder axis C2.

The pipe 79A (i.e., the oil channel 79) extends, firstly, upwards from the oil supply hole 75*a*, and then bends obliquely upward to the rear side and to the inner side of the engine 1 (i.e., to the inner side in the direction of the crankshaft 10). The pipe 79A thus shifts to a position between the drive sprocket 52 (the timing chain 53) and the rightmost one of crankshaft bearings 10*a* that is located at the left side of, and is adjacent to, the drive sprocket 52. After that, the pipe 79A extends along a plane that is orthogonal to the right-and-left direction while curving obliquely upwards to the front side so as to go round the crankshaft 10.

Thereafter, the pipe 79A stays at the further inner side of the engine 1 than the timing chain 53, and extends obliquely towards the cylinder head 2. Then, in the vicinity of the base-end portion of the cylinder 30, the pipe 79A passes through the space located inside the looped timing chain 53 and thus shifts its position to a position located at further outer side of the engine 1 (outer side of the direction of the crankshaft 10) than the timing chain 53. When the timing chain 53 and its surrounding area are viewed, from the outside of the looped timing chain 53 and in a direction orthogonal to the cylinder axis C2 from the front side, the pipe 79A obliquely intersects the timing chain 53 while passing through the space inside the looped timing chain 53 (see FIG. 18).

The pipe 79A that has passed through the inside of the looped timing chain 53 and thus shifted its position to further outer side of the engine 1, extends at the further outer side of the engine 1 than the timing chain 53 towards the cylinder head 2 so as to be substantially parallel with the cylinder axis C2. The upper-end portion of the pipe 79A is connected to a lower-end portion of the hydraulic actuator 65. While the pipe 79A is extending upwards at the further outer side of the engine 1 than the timing chain 53, the pipe 79A is laid substantially over the tensile side of the timing chain 53 when viewed from a side of the engine 1 (see FIG. 17).

FIG. 22 shows a right-side plan view of a motorcycle 101 equipped with the engine 1. A front wheel 102 is rotatably supported at the lower-end portions of a right and a left front forks 103. A front-wheel suspension system 104 that is composed mainly of the right and the left front forks 103 is pivotally supported by a head pipe 106 of a vehicle-body frame 105 so as to be steerable. A rear wheel 107 is rotatably supported at the rear-end portion of a rear swing arm 108. The front-end portion of the rear swing arm 108 is pivotally supported by a right and a left pivot plates 109 of the vehicle-body frame 105 located at a central portion, in the front-to-rear direction, of the vehicle body. The rear swing arm 108 thus supported is swingable up and down.

Right and left main tubes 111 extend from the head pipe 106 obliquely downwards and towards the rear. The rear-end portions of the right and the left main tubes 111 are connected respectively to the upper-end portions of the right and the left pivot plates 109 at central portions, in the front-to-rear direction, of the vehicle body. The engine 1 is mounted below the right and the left main tubes 111.

A right and a left engine hangers 112 extend downwards respectively from the bottom sides of the front-side portions of the right and the left main tubes 111. The front-end portion of the engine 1 is supported by the lower-end portions of the right and the left engine hangers 112. The rear-end portion of the engine 1 is supported by the right and the left pivot plates 109 at appropriate positions in the up and down direction.

The right and the left engine hangers 112 are disposed respectively along the left and right sidewalls of the cylinder head 2.

Figure 23:
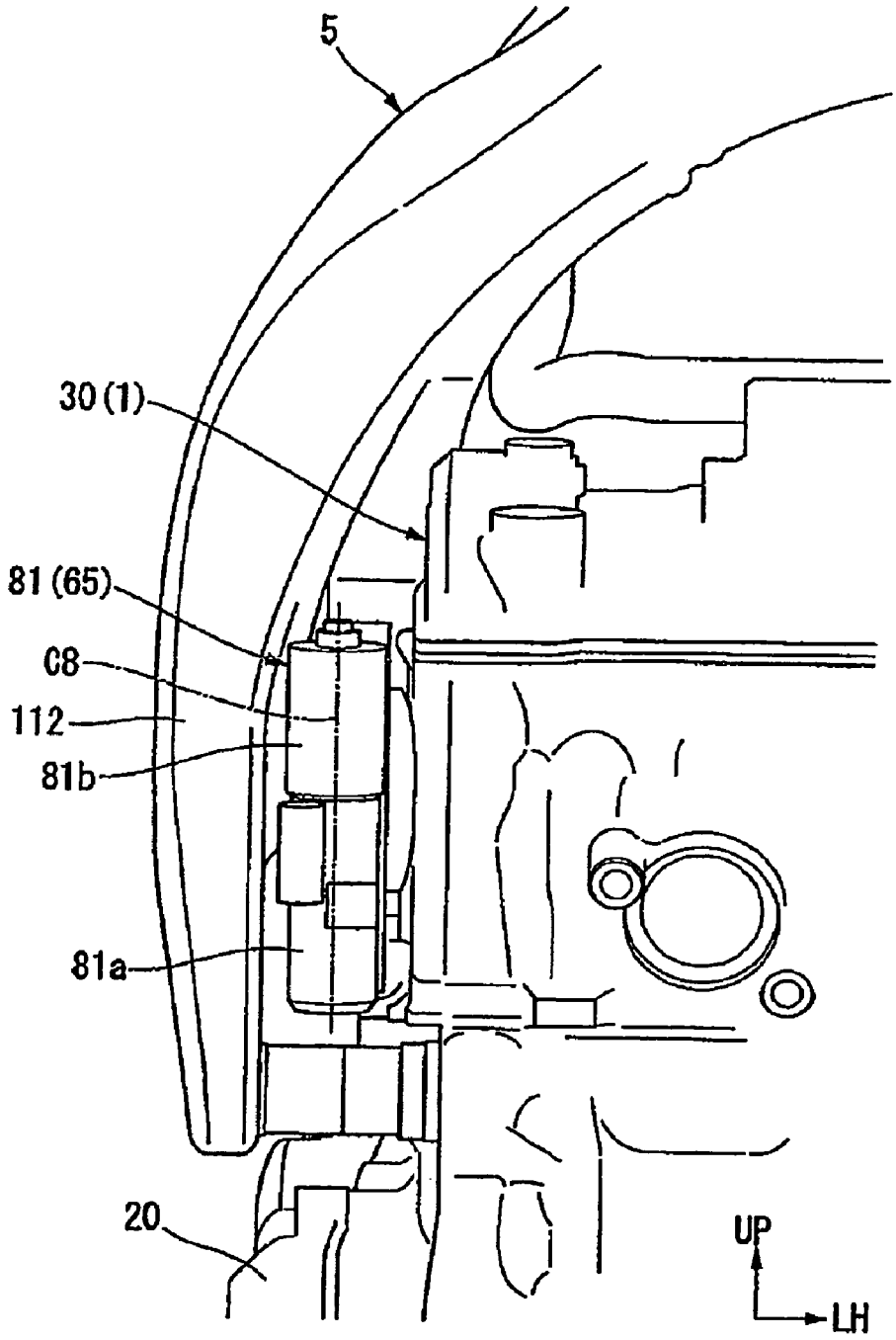
FIG. 23 is a front plan view showing a right engine hanger of the motorcycle.

Now, refer also to FIG. 23. The right engine hanger 112 is placed at the right side of the hydraulic actuator 65. A gap is left between the right engine hanger 112 and the right sidewall of the cylinder head 2, and has a relatively small width in the right-and-left direction. Placed in this relatively narrow gap is the sticking-out portions of the hydraulic actuator 65 (including the spool valve 81) that sticks outwards from the cylinder head 2.

What follows is a description of the operation of the valve mechanism 5.

Suppose a case where the first rocker arm moving mechanism 21 has to accumulate a predetermined force to move the rocker arm 13 that is located at the first operation position (see FIG. 4) to the second operation position. In this case, the hydraulic actuator 65 is firstly activated before the rocker arm 13 opens the valves 6. Thus the rocker arm shaft 14 that is located at the limit position for the leftward movement is moved rightwards together with the spring-receiving collars 25 and 26 (see FIG. 7A).

The movement of the rocker arm shaft 14 in the axial direction surmounts the supported portions 37*c* of the trigger pin 37 on top of the left slope 61*b* of the cut-away recessed portion 61. Accordingly, the trigger pin 37 moves in the orthogonal direction to the rocker axis C5, so that the top portion of the trigger pin 37 pushes upwards the left engagement nail 34 of the trigger arm 33 that has been in the installed state. The left engagement nail 34 is thus pushed out of the central engagement groove 36*b* by a predetermined amount, so that the trigger arm 33 swings clockwise in FIG. 7B (i.e., the trigger arm 33 swings to the opposite side to the rocker arm 13).

At this time, when viewed in the direction of the rocker axis C5, the upper-end portion 38*a* of the left deck-like portion 38 of the rocker arm 13 and the lower-edge portion 34*a* of the left engagement nail 34 of the trigger arm 33 overlap each other by a predetermined amount. Accordingly, the upper-end portion 38*a* of the left deck-like portion 38 and the lower-edge portion 34*a* of the left engagement nail 34 are brought into contact with each other in the direction of the rocker axis C5, so that the overlapping portions restricts the rightward movement of the rocker arm 13 relative to the trigger arm 33 (i.e., relative to the cylinder head 2).

In addition, at this time, when viewed in the direction of the rocker axis C5, the upper-end portion 39*a* of the right deck-like portion 39 of the rocker arm 13 and the lower-edge portion 35*a* of the right engagement nail 35 of the trigger arm 33 overlap each other by a predetermined amount. However, a gap S is left, in the direction of the rocker axis C5, between the upper-end portion 39*a* of the right deck-like portion 39 and the lower-edge portion 35*a* of the right engagement nail 35.

Suppose that the rocker arm shaft 14 and the spring-receiving collars 25 and 26 have been moved from their respective limit positions for the leftward movement to their respective limit positions for the rightward movement. By this time, the first spring 23 placed between the first spring-receiving collar 25 and the shaft-insertion boss 13*a* of the rocker arm 13 subjected to the movement restriction has been compressed by a predetermined amount. Accordingly, the first spring 23 has accumulated a spring force that is large enough to move the rocker arm 13 from the first operation position to the second operation position.

Now suppose a case where: the rocker arm 13 is located at the first operation position; the rocker arm shaft 14 is located at the limit position for the rightward movement; and the trigger arm 33 is in the primary swing state. In this case, if the left and right first cams 15*a* and 16*a* are driven by the rotation of the intake-side camshaft 11 to make the rocker arm 13 swing from the valve-closing side to the valve-opening side (i.e., the cams 15*a* and 16*a* press the rocker arm 13 to lift the intake valves 6; see FIG. 8), the shaft-insertion boss 13*a* moves rotationally and the rotational movement lowers down the upper-end portion 38*a* of the left deck-like portion 38 and raises a little the upper-end portion 39*a* of the right deck-like portion 39 (see FIG. 9A).

Then, suppose that, during a predetermined valve operation period that extends across a point of time when each of the intake valves 6 is lifted by a maximum amount, the overlapping margin of the upper-end portion 38*a* of the left deck-like portion 38 and the lower-edge portion 34*a* of the left engagement nail 34 becomes zero when viewed in the direction of the rocker axis C5 (i.e., the contact margin in the direction of the rocker axis C5 disappears). Then, the restriction imposed by such an overlapping portions on the rightward movement of the rocker arm 13 relative to the cylinder head 2 is removed.

At this time, a certain overlapping margin is still secured between the upper-end portion 39*a* of the right deck-like portion 39 and the lower-edge portion 35*a* of the right engagement nail 35 when viewed in the direction of the rocker axis C5. If the restriction imposed on the rightward movement of the rocker arm 13 by the engagement of the left deck-like portion 38 and the left engagement nail 34 is removed as has been described above, the rocker arm 13 moves rightwards by an amount equivalent to the gap S between the right deck-like portion 39 and the right engagement nail 35 (see FIG. 9B).

At this time, the upper-end portion 39*a* of the right deck-like portion 39 and the lower-edge portion 35*a* of the right engagement nail 35 are brought into contact with each other in the direction of the rocker axis C5. Accordingly, the rightward movement of the rocker arm 13 relative to the cylinder head 2 is restricted. Also at this time, the upper-end portion 38*a* of the left deck-like portion 38 and the lower-edge portion 34*a* of the left engagement nail 34 overlap each other by an amount equivalent to the gap S in the direction of the rocker axis C5.

Then, suppose that, while the left deck-like portion 38 and the left engagement nail 34 overlap each other by a predetermined amount in the direction of the rocker axis C5 as described above, the intake-side camshaft 11 is continuously driven to rotate and the rocker arm 13 is made to swing from the valve-opening side to the valve-closing side. Then, the upper-end portion 38*a* of the left deck-like portion 38 slidably contacts the lower-edge portion 34*a* of the left engagement nail 34, and the trigger arm 33 is made to move rotationally further clockwise in FIG. 8 from the primary swing state.

By the time when the rocker arm 13 swings so that the lift amount of each intake valve 6 becomes zero (i.e., so that the valves 6 are closed completely), the overlapping margin of the upper-end portion 39*a* of the right deck-like portion 39 and the lower-edge portion 35*a* of the right engagement nail 35 has become zero when viewed in the direction of the rocker axis C5 (i.e., the contacting margin in the direction of the rocker axis C5 has disappeared). Then, the restriction imposed by such an overlapping portions on the rightward movement of the rocker arm 13 relative to the cylinder head 2 is removed (see FIG. 10A).

At this time, the restriction imposed on the movement of the rocker arm 13 by the engagement of the left deck-like portion 38 and the left engagement nail 34 has already been removed as well. Accordingly, the spring force accumulated by the first spring 23 moves the rocker arm 13 to the second operation position (see FIG. 10B). Then, the left engagement nail 34 and the left protruding piece 43 overlap the left limit flange 41 by a predetermined amount when viewed in the direction of the rocker axis C5. In addition the left engagement nail 34 and the left protruding piece 43 contact each other in the direction of the rocker axis C5, so that a restriction is imposed on the position of the rocker arm 13 located at the second operation position.

Once the movement of the rocker arm 13 to the second operation position has been completed, the left and right engagement nails 34 and 35 are positioned right above the left and the central engagement grooves 36*a* and 36*b* respectively. In this state, a counterclockwise rotational movement of the trigger arm 33 (towards the rocker arm 13) in FIG. 8 makes the left and right engagement nails 34 and 35 enter the left and the central engagement grooves 36*a* and 36*b*, respectively. At this time the supported portions 37*c* of the trigger pin 37 are moved to the top of the bottom face 61*a* of the cut-away recessed portion 61, and thus the trigger pin 37 is lowered down inside the central engagement groove 36*b*. Accordingly, the trigger arm 33 returns to the installed state, so that a restriction is imposed on the sliding movement, in the direction of the rocker axis C5, of the rocker arm 13 located at the second operation position.

Note that, while the trigger arm 33 is in the installed state, even a swing of the rocker arm 13 does not make the overlapping margin of the left deck-like portion 38 and the left engagement nail 34 disappear completely. Accordingly, the restriction continues to be imposed on the rightward movement of the rocker arm 13 until the trigger arm 33 becomes the primary swing state (that is, until the first spring 23 accumulates a predetermined force).

Subsequently, suppose a case where the second rocker arm moving mechanism 22 has to accumulate a predetermined force to move the rocker arm 13 that is located at the second operation position (see FIG. 11) to the first operation position. In this case, the hydraulic actuator 65 is firstly activated before the rocker arm 13 opens the valves 6. Thus the rocker arm shaft 14 that is located at the limit position for the rightward movement is moved leftwards together with the spring-receiving collars 25 and 26 (see FIG. 12).

The movement of the rocker arm shaft 14 in the axial direction surmounts the supported portions 37 of the trigger pin 37 on top of the right slope 61*c* of the cut-away recessed portion 61. Accordingly, the trigger pin 37 moves in the orthogonal direction to the rocker axis C5, so that the top portion of the trigger pin 37 pushes upwards the right engagement nail 35 of the trigger arm 33 that has been in the installed state. The right engagement nail 35 is thus pushed out of the central engagement groove 36*b* by a predetermined amount, so that the trigger arm 33 swings clockwise in FIG. 7B (i.e., the trigger arm 33 swings to the opposite side to the rocker arm 13).

At this time, when viewed in the direction of the rocker axis C5, the upper-end portion 38*a* of the left deck-like portion 38 of the rocker arm 13 and the lower-edge portion 34*a* of the left engagement nail 34 of the trigger arm 33 overlap each other by a predetermined amount. Accordingly, the upper-end portion 38*a* of the left deck-like portion 38 and the lower-edge portion 34*a* of the left engagement nail 34 are brought into contact with each other in the direction of the rocker axis C5, so that the overlapping portions restricts the leftward movement of the rocker arm 13 relative to the trigger arm 33 (i.e., relative to the cylinder head 2).

In addition, at this time, when viewed in the direction of the rocker axis C5, the upper-end portion 39*a* of the right deck-like portion 39 of the rocker arm 13 and the lower-edge portion 35*a* of the right engagement nail 35 of the trigger arm 33 overlap each other by a predetermined amount. However, a gap S is left, in the direction of the rocker axis C5, between the upper-end portion 39*a* of the right deck-like portion 39 and the lower-edge portion 35*a* of the right engagement nail 35.

Suppose that the rocker arm shaft 14 and the spring-receiving collars 25 and 26 have been moved from their respective limit positions for the rightward movement to their respective limit positions for the leftward movement. By this time, the second spring 24 placed between the second spring-receiving collar 26 and the shaft-insertion boss 13*a* of the rocker arm 13 subjected to the movement restriction has been compressed by a predetermined amount. Accordingly, the second spring 24 has accumulated a spring force that is large enough to move the rocker arm 13 from the second operation position to the first operation position.

Figure 13A:
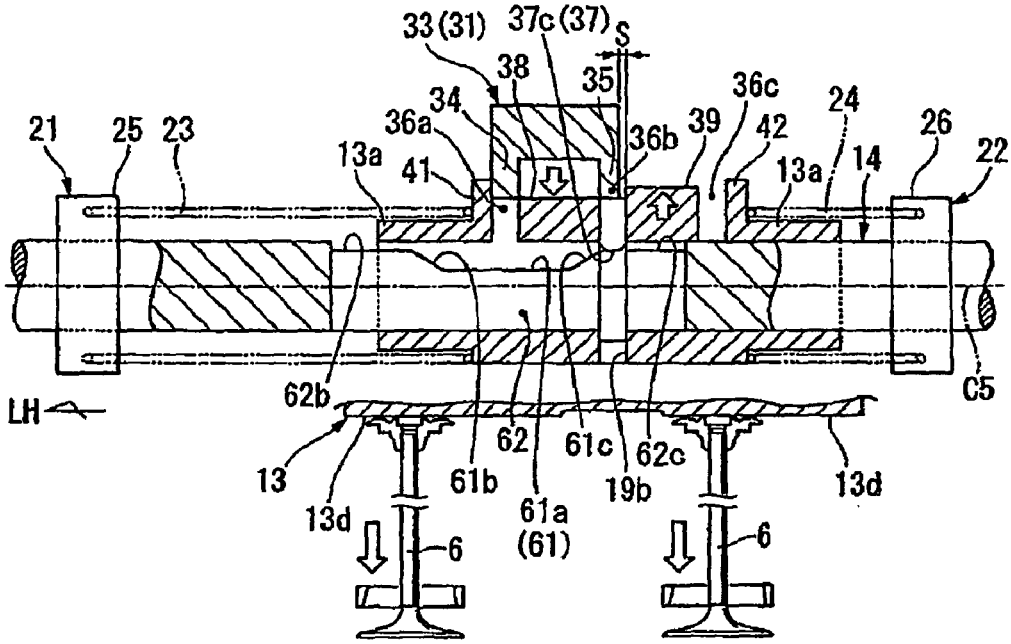
FIG. 13A is a sectional view of the intake-side rocker arm shaft corresponding to FIG. 11 but illustrating a state where the rocker arm is turned to be in a valve opening state.

Now suppose a case where: the rocker arm 13 is located at the second operation position; the rocker arm shaft 14 is located at the limit position for the leftward movement; and the trigger arm 33 is in the primary swing state. In this case, if the left and right second cams 15*b* and 16*b* are driven by the rotation of the intake-side camshaft 11 to make the rocker arm 13 swing from the valve-closing side to the valve-opening side (i.e., the cams 15*b* and 16*b* press the rocker arm 13 to lift the intake valves 6; see FIG. 8), the shaft-insertion boss 13*a* moves rotationally and the rotational movement lowers down the upper-end portion 38*a* of the left deck-like portion 38 and raises a little the upper-end portion 39*a* of the right deck-like portion 39 (see FIG. 13A).

Then, suppose that, during a predetermined valve operation period that extends across a point of time when each of the intake valves 6 is lifted by a maximum amount, the overlapping margin of the upper-end portion 38*a* of the left deck-like portion 38 and the lower-edge portion 34*a* of the left engagement nail 34 becomes zero when viewed in the direction of the rocker axis C5 (i.e., the contact margin in the direction of the rocker axis C5 disappears). Then, the restriction imposed by such an overlapping portions on the leftward movement of the rocker arm 13 relative to the cylinder head 2 is removed.

Figure 13B:
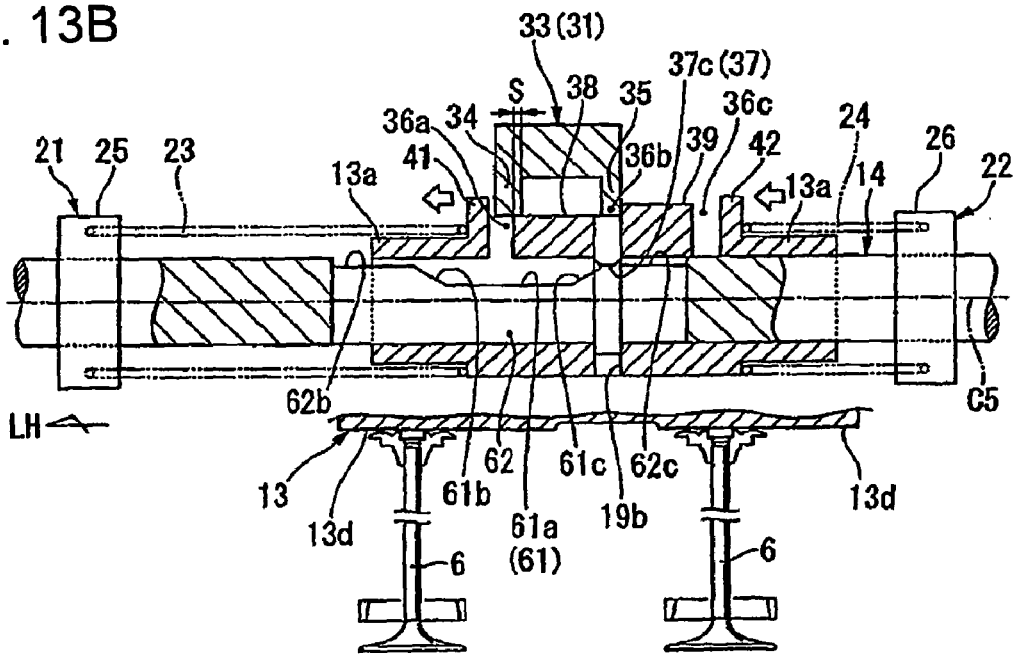
FIG. 13B is a sectional view of the intake-side rocker arm shaft corresponding to FIG. 11 but illustrating a state accomplished when the rocker arm moves in the axial direction by an amount equivalent to a gap S from its state shown in FIG. 13A.

At this time, a certain overlapping margin is still secured between the upper-end portion 39*a* of the right deck-like portion 39 and the lower-edge portion 35*a* of the right engagement nail 35 when viewed in the direction of the rocker axis C5. If the restriction imposed on the leftward movement of the rocker arm 13 by the engagement of the left deck-like portion 38 and the left engagement nail 34 is removed as has been described above, the rocker arm 13 moves leftwards by an amount equivalent to the gap S between the right deck-like portion 39 and the right engagement nail 35 (see FIG. 13B).

At this time, the upper-end portion 39*a* of the right deck-like portion 39 and the lower-edge portion 35*a* of the right engagement nail 35 are brought into contact with each other in the direction of the rocker axis C5. Accordingly, the leftward movement of the rocker arm 13 relative to the cylinder head 2 is restricted. Also at this time, the upper-end portion 38*a* of the left deck-like portion 38 and the lower-edge portion 34*a* of the left engagement nail 34 overlap each other by an amount equivalent to the gap S in the direction of the rocker axis C5.

Then, suppose that, while the left deck-like portion 38 and the left engagement nail 34 overlap each other by a predetermined amount in the direction of the rocker axis C5 as described above, the intake-side camshaft 11 is continuously driven to rotate and the rocker arm 13 is made to swing from the valve-opening side to the valve-closing side. Then, the upper-end portion 38*a* of the left deck-like portion 38 slidably contacts the lower-edge portion 34*a* of the left engagement nail 34, and the trigger arm 33 is made to move rotationally further clockwise in FIG. 8 from the primary swing state.

Figure 14A:
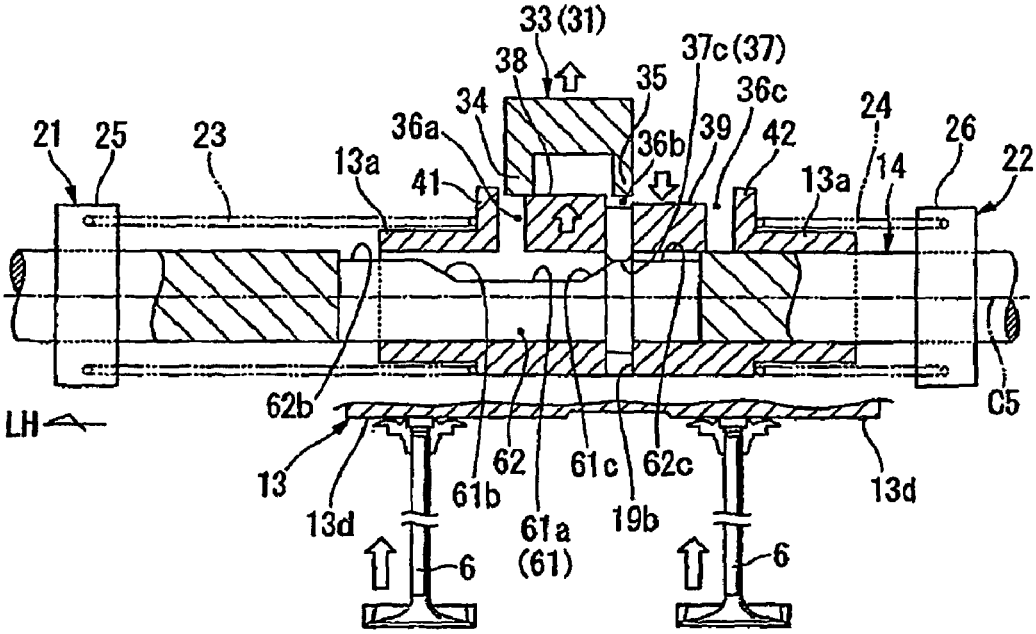
FIG. 14A is a sectional view of the intake-side rocker arm shaft corresponding to FIG. 11 but illustrating a state where the rocker arm is turned to be in a valve closing state.

By the time when the rocker arm 13 swings so that the lift amount of each intake valve 6 becomes zero (i.e., so that the valves 6 are closed completely), the overlapping margin of the upper-end portion 39*a* of the right deck-like portion 39 and the lower-edge portion 35*a* of the right engagement nail 35 has become zero when viewed in the direction of the rocker axis C5 (i.e., the contacting margin in the direction of the rocker axis C5 has disappeared). Then, the restriction imposed by such an overlapping portions on the leftward movement of the rocker arm 13 relative to the cylinder head 2 is removed (see FIG. 14A).

Figure 14B:
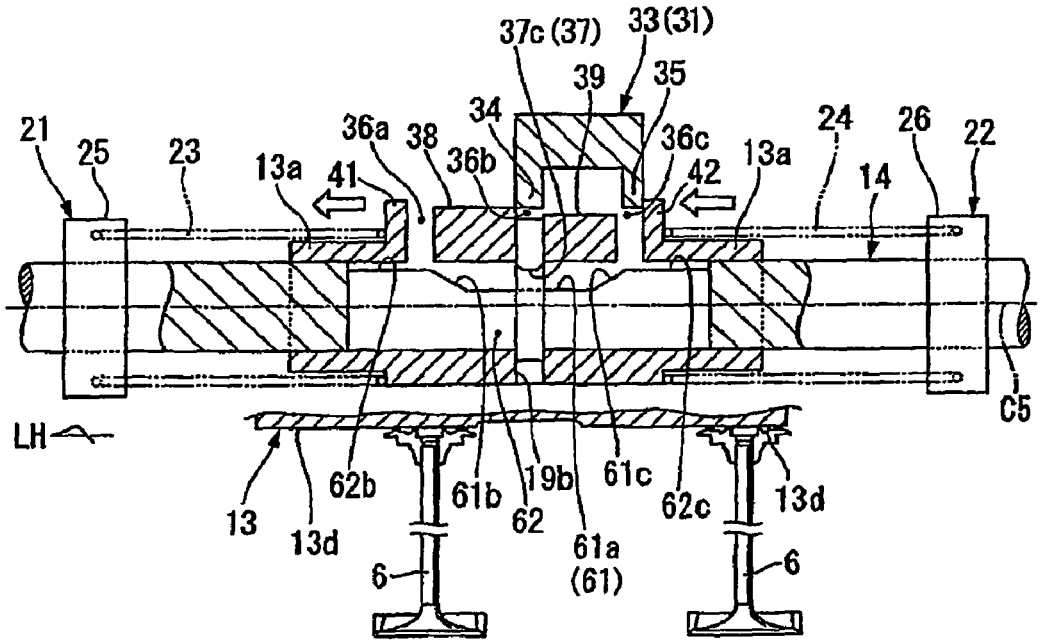
FIG. 14B is a sectional view of the intake-side rocker arm shaft corresponding to FIG. 11 but illustrating a transitional state where the rocker arm moves to the first operation position.

At this time, the restriction imposed on the movement of the rocker arm 13 by the engagement of the left deck-like portion 38 and the left engagement nail 34 has already been removed as well. Accordingly, the spring force accumulated by the second spring 24 moves the rocker arm 13 to the first operation position (see FIG. 14B). Then, the right engagement nail 35 and the right protruding piece 44 overlap the right limit flange 42 by a predetermined amount when viewed in the direction of the rocker axis C5. In addition, the right engagement nail 35 and the right protruding piece 44 contact each other in the direction of the rocker axis C5, so that a restriction is imposed on the position of the rocker arm 13 located at the first operation position.

Once the movement of the rocker arm 13 to the first operation position has been completed, the left and right engagement nails 34 and 35 are positioned right above the central and the right engagement grooves 36*b* and 36*c* respectively. In this state, a counterclockwise rotational movement of the trigger arm 33 (towards the rocker arm 13) in FIG. 8 makes the left and right engagement nails 34 and 35 enter the central and the right engagement grooves 36*b* and 36*c*, respectively. At this time the supported portions 37*c* of the trigger pin 37 are moved to the top of the bottom face 61*a* of the cut-away recessed portion 61, and thus the trigger pin 37 is lowered down inside the central engagement groove 36*b*. Accordingly, the trigger arm 33 returns to the installed state, so that a restriction is imposed on the sliding movement, in the direction of the rocker axis C5, of the rocker arm 13 located at the first operation position.

Note that, while the trigger arm 33 is in the installed state, even a swing of the rocker arm 13 does not make the overlapping margin of the left deck-like portion 38 and the left engagement nail 34 disappear completely. Accordingly, the restriction continues to be imposed on the leftward movement of the rocker arm 13 until the trigger arm 33 becomes the primary swing state (that is, until the second spring 24 accumulates a predetermined force).

As has been described thus far, the opening-closing timings for the intake valves 6 and the lift amount for the valves 6 are switched appropriately (i.e., are made variable) between a case where the engine 1 is not in operation or is running (crankshaft 10 revolves) at a low speed and a case where the engine 1 is running at a high speed. Accordingly, while the engine 1 is running at a low speed, the valve overlap can be reduced and the lift amount can be decreased. In contrast, while the engine 1 is running at a high speed, the valve overlap can be increased and the lift amount can be increased.

As has been described thus far, in the engine 1 equipped with a variable valve control system according to the embodiment, the intake-side rocker arm 13 (or the exhaust-side rocker arm 17) is disposed between the intake engine valves 6 (or the exhaust valves 7) and the left and right first cams 15*a* and 16*a* as well as between the intake engine valves 6 and the left and right second cams 15*b* and 16*b* for the intake valves 6. The rocker arm 13 is supported by the intake-side rocker arm shaft 14 (or the exhaust-side rocker arm shaft 18) swingably and slidably in the axial direction of the intake-side rocker arm shaft 14. The rocker arm 13 (or the rocker arm 17) is made to engage selectively with one of the two combinations of cams—either the combination of the first cams 15*a* and 16*a* or the combination of the second cams 15*b* and 16*b* by a sliding movement of the rocker arm 13 (or the rocker arm 17) in the axial direction in response to the movement of the rocker arm shaft 14 (or the rocker arm shaft 18), and thus the actions of the intake valves 6 (or the exhaust valves 7) are switched from one to the other. The engine 1 includes: the hydraulic actuator 65 that moves the rocker arm shaft 14 or 18 in the axial directions of the rocker arm shaft 14 or 18; the trigger arm 33 that engages with the rocker arm 13 or 17 and thereby makes the sliding movement of the rocker arm 13 or 17 impossible; and the trigger pin 37 which is activated by the axial movement of the rocker arm shaft 14 or 18 and which causes an action of the trigger arm 33 to disengage the trigger arm 33 from the rocker arm 13 or 17.

According to this configuration, the restriction imposed on the sliding movement of the rocker arm 13 or 17 can be removed irrespective of the engine speed by an axial movement of the rocker arm shaft 14 or 18 caused by activating the hydraulic actuator 65 in accordance with the timings of the actions of the rocker arm 13 or 17. Consequently, the rocker arm 13 or 17 can slidably move in accordance with the timings of the actions of the rocker arm 13 or 17.

In addition, the engine 1 may have the following configuration. The axial movement of the rocker arm shaft 14 or 18 makes the trigger pin 37 move in a direction orthogonal to the axial direction of the rocker arm shaft 14 or 18. The movement of the trigger pin 37 causes the action of the trigger arm 33 to disengage the trigger arm 33 from the rocker arm 13 or 17. Accordingly, the trigger arm 33 can be reliably disengaged from the rocker arm 13 or 17.

In addition, the engine 1 may have the following configuration. The cut-away recessed portion 61 is formed in the outer circumference of the rocker arm shaft 14 or 18, and the cut-away recessed portion 61 includes the slopes 61*b* and 61*c* inclined with respect to the axial direction of the rocker arm shaft 14 or 18. The trigger pin 37 is supported on top of the slopes 61*b* and 61*c* by the axial movement of the rocker arm shaft 14 or 18, and thereby moves in the direction orthogonal to the axial direction of the rocker arm shaft 14 or 18. Accordingly, the mechanism with only a simple configuration is needed to move the trigger pin 37 in the direction orthogonal to the axial direction of the rocker arm shaft 14 or 18.

In addition to the above, the cut-away recessed portion 61 includes the flat bottom face 61*a* which is contiguous from the slopes 61*b* and 61*c*, and which extends in a parallel direction with the axial direction of the rocker arm shaft 14 or 18. The trigger pin 37 includes the supported portions 37*c* that are supported on top of the bottom face 61*a* before the trigger pin 37 is activated by the axial movement of the rocker arm shaft 14 or 18. Accordingly, the trigger pin 37 can be kept in a non-action state reliably and stably before the action of the trigger pin 37, that is, while the engine 1 is running ordinarily without switching between the combination of the cams 15*a* and 16*a* and the combination of the cams 15*b* and 16*b*.

In addition, the engine 1 may have the following configuration. The bottom face 61*a* has a width, in the axial direction of the rocker arm shaft 14 or 18, that is larger than the width, in the axial direction of the rocker arm shaft 14 or 18, of each of the slopes 61*b* and 61*c*. The supported portions 37*c* of the trigger pin 37 are supported on top of a substantially central portion, in the axial direction of the rocker arm shaft 14 or 18, of bottom face 61*a* before the trigger pin 37 is activated by the axial movement of the rocker arm shaft 14 or 18. Accordingly, the trigger pin 37 can be supported safely in the non-action state so that no erroneous action of the trigger pin 37 will be caused by such factors as the engine vibrations and so that the restriction on the sliding movement of the rocker arm 13 or 17 can be reliably removed.

In addition, the slit-shaped through-hole 62 is formed in the rocker arm shaft 14 or 18 so as to pass through the rocker arm shaft 14 or 18 in a direction orthogonal to the axial direction of the rocker arm shaft 14 or 18. The through-hole 62 has its longitudinal side extending in the axial direction of the rocker arm shaft 14 or 18. The inserting portion 37*a* that is inserted into the through-hole 62 movably in the axial direction of the rocker arm shaft 14 or 18 is formed in the trigger pin 37. Accordingly, the insertion prevents the trigger pin 37 from rotating relative to the rocker arm shaft 14 or 18, and thus prevents the trigger pin 37 from being supported on top of the slopes 61*b* and 61*c*. Consequently, the restriction imposed on the sliding movement of the rocker arm 13 or 17 can be reliably removed.

In addition, the engine 1 may have the following configuration. The through-hole 62 is formed in a substantially central portion of the width of the cut-away recessed portion 61 in the direction orthogonal to the axial direction of the rocker arm shaft 14 or 18. The through-hole 62 is formed so as to cover the entire length of the cut-away recessed portion 61 in the axial direction of the rocker arm shaft 14 or 18. The wider portion 37*b* is formed in an end portion of the inserting portion 37*a* of the trigger pin 37. The wider portion 37*b* has a larger width in the direction orthogonal to the axial direction of the rocker arm shaft 14 or 18 than both the inserting portion 37*a* and the through-hole 62. The supported portions 37*c* to come into contact with the slopes 61*b* and 61*c* of the cut-away recessed portion 61 are formed in the wider portion 37*b*. Accordingly, the surface pressure at the time when the trigger pin 37 (the supported portions 37*c*) is supported on top of the slopes 61*b* and 61*c* is diffused, so that the trigger pin 37 can be moved smoothly.

In addition, the engine 1 may have the following configuration. The inserting portion 37*a* passes through the through-hole 62 and thereby penetrates the rocker arm shaft 14 or 18 so as to stick out from the outer-circumference surface of the rocker arm shaft 14 or 18. The wider portion 37*b* also sticks out from the outer-circumferential surface of the rocker arm shaft 14 or 18. The fitting holes 19*a* and 19*b* are formed in the shaft-insertion boss 13*a* of the rocker arm 13 or 17 so that the sticking-out portion of the inserting portion 37*a* and the wider portion 37*b* can be inserted into and fitted to the fitting holes 19*a* and 19*b*. Accordingly, the two end portions of the trigger pin 37 can be supported at two positions by use of the shaft-insertion boss 13*a* of the rocker arm 13 or 17, so that the force acting on the trigger pin 37 can be diffused. Consequently, the strength and the rigidity of the trigger pin 37 can be secured efficiently.

Note that the configuration described in the embodiment above is only an example of the present invention. Various modifications can be made without departing from the scope of the invention. For example, the accumulator 84 shown in FIG. 20 is not essential for the implementation of the present invention, so the accumulator 84 may be omitted. In addition, the information on the gear position and on the vacuum inside the intake pipe, which is inputted into the ECU 78, may be omitted as well.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An internal combustion engine equipped with a variable valve control system comprising an engine valve, a camshaft having first and second cams thereon for selectively engaging the engine valve, and a rocker arm disposed between the engine valve and the camshaft;

wherein the rocker arm is pivotally supported on a rocker arm shaft and is slidably movable in an axial direction of the rocker arm shaft, and the rocker arm is also axially slidable in response to a movement of the rocker arm shaft to selectively engage with one of said cams, whereby control of the engine valve is switchable between said cams, said variable valve control system further comprising:

an actuator for selectively moving the rocker arm shaft in the axial direction thereof;

a stopper that is engageable with the rocker arm to temporarily prevent the rocker arm from sliding; and a release member which is configured to be activated by an axial movement of the rocker arm shaft, and which is operable to disengage the stopper from the rocker arm.

2. The internal combustion engine equipped with a variable valve control system of claim 1, wherein the release member is movable in a direction orthogonal to the axial direction of the rocker arm shaft in response to the axial movement of the rocker arm shaft, and wherein such orthogonal movement of the release member operates to disengage the stopper from the rocker arm.

3. The internal combustion engine equipped with a variable valve control system of claim 2, wherein a portion of the rocker arm shaft has a cut-away recessed portion formed in an outer circumference thereof, the cut-away recessed portion having a slope inclined with respect to the axial direction, and wherein the release member is moved up the slope by the axial movement of the rocker arm shaft, and thereby moves in the direction orthogonal to the axial direction.

4. The internal combustion engine equipped with a variable valve control system of claim 3, wherein:

the cut-away recessed portion includes a flat bottom face which is contiguous with the slope and is parallel with the axis of the rocker arm shaft, and the release member includes a supported portion that is supported on top of the bottom face before the release member is activated by the axial movement of the rocker arm shaft.

5. The internal combustion engine equipped with a variable valve control system of claim 4, wherein:

the slope has a first width in the axial direction of the rocker arm shaft;

the bottom face has a larger width in the axial direction than the width of the slope, and the supported portion of the release member is supported on a substantially central portion of the bottom face before the release member is activated by the axial movement of the rocker arm shaft.

6. The internal combustion engine equipped with a variable valve control system of claim 3, wherein the rocker arm shaft has a slit-shaped through-hole formed therein, the through-hole passing through the rocker arm shaft in a direction orthogonal to the axial direction and having its longitudinal side extending in the axial direction, and the release member comprises an inserting portion which is inserted into the through-hole so as to be movable in the axial direction.

7. The internal combustion engine equipped with a variable valve control system of claim 6, wherein the through-hole is formed in a substantially central portion of the cut-away recessed portion in the direction orthogonal to the axial direction, the through-hole being formed so as to substantially cover the entire length of the cut-away recessed portion in the axial direction, a wider portion is formed in an end portion of the inserting portion of the release member, the wider portion having a larger width in the direction orthogonal to the axial direction than both the inserting portion and the through-hole, and the wider portion is provided with the supported portion that is to come into contact with the slope of the cut-away recessed portion.

8. The internal combustion engine equipped with a variable valve control system of claim 7, wherein the inserting portion penetrates the rocker arm shaft by passing through the through-hole, and thereby sticks out from the outer-circumference surface of the rocker arm shaft, the wider portion also sticks out from the outer-circumferential surface of the rocker arm shaft, and a fitting hole is formed in a shaft-insertion boss of the rocker arm so that the sticking-out portions of the inserting portion and the wider portion can be inserted into and fitted to the fitting hole.

9. An internal combustion engine equipped with a variable valve control system comprising an engine valve, a camshaft having first and second cams thereon for selectively engaging the engine valve, and a rocker arm disposed between the engine valve and the camshaft;

wherein the rocker arm is pivotally supported on a rocker arm shaft and is slidably movable in an axial direction of the rocker arm shaft, and the rocker arm is also axially slidable in response to a movement of the rocker arm shaft to selectively engage with one of said cams, whereby control of the engine valve is switchable between said cams, said variable valve control system further comprising:

an actuator for selectively moving the rocker arm shaft in the axial direction thereof;

a stopper that is engageable with the rocker arm to temporarily prevent the rocker arm from sliding; and a release member which is configured to be activated by an axial movement of the rocker arm shaft and which is operable to disengage the stopper from the rocker arm;

wherein the release member is movable in a direction orthogonal to the axial direction of the rocker arm shaft in response to the axial movement of the rocker arm shaft, and wherein such orthogonal movement of the release member operates to disengage the stopper from the rocker arm;

wherein a portion of the rocker arm shaft has a cut-away recessed portion formed in an outer circumference thereof, the cut-away recessed portion having a slope inclined with respect to the axial direction;

and wherein the release member is moved up the slope by the axial movement of the rocker arm shaft, and thereby moves in the direction orthogonal to the axial direction.

10. The internal combustion engine equipped with a variable valve control system of claim 9, wherein:

the cut-away recessed portion includes a flat bottom face which is contiguous with the slope and is parallel with the axis of the rocker arm, and the release member includes a supported portion that is supported on top of the bottom face before the release member is activated by the axial movement of the rocker arm shaft.

11. The internal combustion engine equipped with a variable valve control system of claim 10, wherein the bottom face has a larger width in the axial direction than the slope has, and wherein the supported portion of the release member is supported on top of a substantially central portion of the bottom face before the release member is activated by the axial movement of the rocker arm shaft.

12. The internal combustion engine equipped with a variable valve control system of claim 9, wherein the rocker arm shaft has a slit-shaped through-hole formed therein, the through-hole passing through the rocker arm shaft in a direction orthogonal to the axial direction and having its longitudinal side extending in the axial direction, and the release member comprises an inserting portion which is inserted into the through-hole so as to be movable in the axial direction.

13. The internal combustion engine equipped with a variable valve control system of claim 12, wherein:

the through-hole is formed in a substantially central portion of the cut-away recessed portion in the direction orthogonal to the axial direction, the through-hole being formed so as to substantially cover the entire length of the cut-away recessed portion in the axial direction, a wider portion is formed in an end portion of the inserting portion of the release member, the wider portion having a larger width in the direction orthogonal to the axial direction than both the inserting portion and the through-hole, and the wider portion is provided with the supported portion that is to come into contact with the slope of the cut-away recessed portion.

14. The internal combustion engine equipped with a variable valve control system of claim 13, wherein:

the inserting portion penetrates the rocker arm shaft by passing through the through-hole, and thereby sticks out from the outer-circumference surface of the rocker arm shaft, the wider portion also sticks out from the outer-circumferential surface of the rocker arm shaft, and a fitting hole is formed in a shaft-insertion boss of the rocker arm so that the sticking-out portions of the inserting portion and the wider portion can be inserted into and fitted to the fitting hole.

15. An internal combustion engine, comprising:

a cylinder head having a first hollow bore formed therein to receive a camshaft, a second hollow bore formed therein to receive a rocker arm shaft, a third hollow bore formed therein to receive a trigger arm support shaft, and a fourth hollow bore formed therein to slidably support an engine valve;

a camshaft rotatably supported in the first hollow bore and having first and second cams thereon for selectively engaging the engine valve;

a rocker arm shaft slidably disposed in the second hollow bore and having a rocker axis;

a rocker arm pivotally supported on the rocker arm shaft and slidably movable in an axial direction of the rocker arm shaft, the rocker arm disposed between the engine valve and the camshaft, wherein the rocker arm is axially slidable in response to a movement of the rocker arm shaft to selectively engage with one of said cams, whereby control of the engine valve is switchable between said cams, wherein the camshaft is operable to pivotally move the rocker arm and to slidably move the engine valve in the cylinder head;

a trigger arm support shaft disposed in the third hollow bore;

a trigger arm pivotally supported on the trigger arm support shaft; and a variable valve control system comprising:

an actuator for selectively moving the rocker arm shaft in the axial direction thereof;

a stopper that is engageable with the rocker arm to temporarily prevent the rocker arm from sliding; and a release member which is configured to be activated by an axial movement of the rocker arm shaft and which is operable to disengage the stopper from the rocker arm.

16. The internal combustion engine equipped with a variable valve control system of claim 15, wherein the release member is movable in a direction orthogonal to the axial direction of the rocker arm shaft in response to the axial movement of the rocker arm shaft, and wherein such orthogonal movement of the release member operates to disengage the stopper from the rocker arm.

17. The internal combustion engine equipped with a variable valve control system of claim 16, wherein a portion of the rocker arm shaft has a cut-away recessed portion formed in an outer circumference thereof, the cut-away recessed portion having a slope inclined with respect to the axial direction, and wherein the release member is moved up the slope by the axial movement of the rocker arm shaft, and thereby moves in the direction orthogonal to the axial direction.

18. The internal combustion engine equipped with a variable valve control system of claim 17, wherein the cut-away recessed portion includes a flat bottom face which is contiguous with the slope and is parallel with the axis of the rocker arm, and wherein the release member includes a supported portion that is supported on top of the bottom face before the release member is activated by the axial movement of the rocker arm shaft.

19. The internal combustion engine equipped with a variable valve control system of claim 18, wherein the bottom face has a larger width in the axial direction than the slope, and wherein the supported portion of the release member is supported on top of a substantially central portion of the bottom face before the release member is activated by the axial movement of the rocker arm shaft.

20. The internal combustion engine equipped with a variable valve control system of claim 17, wherein the rocker arm shaft has a slit-shaped through-hole formed therein, the through-hole passing through the rocker arm shaft in a direction orthogonal to the axial direction and having its longitudinal side extending in the axial direction, and wherein the release member comprises an inserting portion which is inserted into the through-hole so as to be movable in the axial direction.

* * * * *